United States Patent [19]

Wickham et al.

[11] Patent Number: 4,554,624

[45] Date of Patent: Nov. 19, 1985

[54] RAILROAD MEASURING, GAUGING AND SPIKING APPARATUS

[75] Inventors: Thomas D. Wickham, Fairmont; Wayne R. Monson, Hamburg, both of Minn.

[73] Assignee: Harsco Corporation, Camp Hill, Pa.

[21] Appl. No.: 547,396

[22] Filed: Oct. 31, 1983

[51] Int. Cl.[4] ..... G05B 13/02; E01B 29/04; E01B 35/02; B61K 9/08

[52] U.S. Cl. ..... 364/148; 33/287; 33/338; 33/144; 33/146; 104/7 A

[58] Field of Search ..... 364/148, 560, 571; 33/1 Q, 287, 338, 144, 146, 149 J; 73/146; 104/7 A, 7 B, 8

[56] References Cited

U.S. PATENT DOCUMENTS

| | | | |
|---|---|---|---|
| 3,380,394 | 4/1968 | Fornerod | 104/8 |
| 3,515,984 | 6/1970 | King et al. | 324/34 |
| 3,552,320 | 1/1971 | Traupmann | 104/17 |
| 3,717,101 | 12/1973 | Katcha et al. | 104/17 |
| 3,939,331 | 2/1976 | Theurer et al. | 73/146 X |
| 3,952,665 | 4/1976 | Stewart et al. | 104/8 |
| 3,990,154 | 11/1976 | Theurer et al. | 33/144 |
| 4,040,938 | 8/1977 | Wagner | 33/287 X |
| 4,100,480 | 7/1978 | Lytle et al. | 324/207 |
| 4,134,065 | 1/1979 | Bauer et al. | 324/208 |
| 4,155,176 | 5/1979 | Goël et al. | 33/1 Q |
| 4,166,291 | 8/1979 | Shupe | 364/560 |
| 4,176,456 | 12/1979 | von Beckmann | 33/1 Q |
| 4,356,771 | 11/1982 | Theurer | 33/287 X |
| 4,363,274 | 12/1982 | Lund | 33/149 J |
| 4,367,681 | 1/1983 | Stewart et al. | 104/7 B |
| 4,460,035 | 7/1984 | Mizote et al. | 364/148 X |
| 4,497,255 | 2/1985 | Theurer | 33/1 Q |

FOREIGN PATENT DOCUMENTS

| | | |
|---|---|---|
| 2127543 | 9/1982 | United Kingdom . |
| 753968 | 8/1980 | U.S.S.R. . |

OTHER PUBLICATIONS

"Rexnord" advertisement, *Railway Track and Structures,* Mar. 1983, pp. 81–82.

*Primary Examiner*—Joseph Ruggiero
*Assistant Examiner*—Jon D. Grossman
*Attorney, Agent, or Firm*—Kerkam, Stowell, Kondracki & Clarke

[57] ABSTRACT

A railroad measuring, gauging, and spiking apparatus uses a closed servoloop arrangement to provide accurate rail gauging. An LVDT sensing arrangement uses three rail feeler wheels to sense the rail gauge immediately adjacent to spiking guns on the apparatus. The output from the LVDT sensor is fed into a signal processing circuit which compares this signal with the desired track gauge in addition to calibrating various analog signals. A gauger control circuit comprises a microprocessor chip which raises and lowers a gauger mechanism and causes the gauger mechanism to track an error signal output by the signal processing circuit until the error signal is equal to zero. The hammers of the spiking guns are interlocked to receive an OK TO SPIKE signal from the microprocessor such that the spiking can not take place until the circuits indicate that the rails are properly gauged.

41 Claims, 11 Drawing Figures

RAILROAD MEASURING, GAUGING AND SPIKING APPARATUS

BACKGROUND OF THE INVENTION

This invention relates to a railroad measuring, gauging, and spiking apparatus.

A common problem in the railroad industry is the tendency of rails to deviate from their proper gauge. Generally speaking, the rails have a tendency to spread apart after trains have repeatedly passed over them. Because of this problem, it is necessary to regauge rails from time to time. It is important that the rails be gauged as accurately as possible both in regauging the rails and in initially laying them.

When rail which has previously been laid is being regauged, it is necessary to remove spikes in tie plates on one of the two rails in the track. Various machines may proceed along a track and remove the spikes to loosen one of the two rails.

Following the loosening of one of the rails, it is necessary to gauge the rail into proper position. Various machines have been used to bring the loose rail into proper gauge with the fixed rail. Once the loose rail is back into proper gauge with the fixed rail it is spiked into position. Typically, the machine which gauges and spikes will then move down four ties from the position which was just spiked and gauge and spike the loose rail at that point. Thus, the loose rail is spiked in proper gauge approximately every four ties after which the intervening ties may be spiked either by the same machine or by a spiker which does not include a gauger or gauging mechanism.

Among the numerous prior art devices adapted for gauging and spiking are those which include measuring devices to indicate the actual gauge of the rail. In theory, the operator can wait until the gauging mechanism has brought the rail into accurate gauge and then activate valves or switches which control the spiking gun or guns on the spiker. However, in actual practice, the operator of the spiking mechanism concentrates on lining up the spikes with the holes in the rail tie plates. Looking up to check the gauge for each tie slows the spiking process down considerably. Accordingly, most operators typically will gauge and spike ten or twelve ties before checking the gauge meter to see if the gauging mechanism is properly bringing the rails to gauge. Not only does this result in a less accurate gauging of the rails then is desirable, but it also slows the operator down since he may have to adjust the gauging mechanism every ten or twelve ties to prevent major errors in gauging.

Thus, a problem typical of prior art gauger and spiker machines is that the operator must visually view the meter in order to determine that the mechanism is properly gauging. If he views the meter quite often, it will take a longer amount of time to gauge and spike a given length of track. On the other hand, if he does not view the meter often enough, the rails will have significant errors in gauging.

Another problem common to prior art gauging and spiking mechanism is that the meter typically gives a gauge measurement for a point significantly removed from the point of spiking. In particular, the spiking guns prevent one from taking a gauge measurement right at the point of spiking. Accordingly, such prior art devices typically will take a gauge measurement at least several inches and possibly more than a foot away from the actual point of spiking. This introduces inaccuracies in the measurement since the point of spiking may be at a different gauge then the place at which the gauge is being measured.

Various types of sensors have been used for measuring the gauge in prior art measuring, gauging, and spiking machines. For example, the use of a linear variable differential transformer (LVDT), have been used for measuring the gauge of rails. Such LVDT's have been used in a telescoping tube having a rail feeler wheel at each end. Since such LVDT devices have a DC output dependent upon the position of a core relative to several coils, the core is movable to change the coupling between the coils depending upon the distance between the rail feeler or gauging wheels. Alternatively, the coils could be movable depending upon the distance between the gauging wheels. In either case, the DC output will be representative of the gauge of the rail at the points of contact of the gauging wheels. The telescoping tube in which the LVDT is mounted extends perpendicular to the rails. A spring may be disposed within the telescoping tube to bias the gauge wheels apart and ensure contact with the rails.

In addition to the problems of slow speed and inaccurate gauging common among prior art machines for the reasons mentioned above, prior art devices have had other problems. For example, although an experienced spiker operator can usually stop the machine so that the spiking guns are positioned adjacent the hole or holes into which spikes are to be inserted, it is usually necessary to move the spiker relative to the vehicle frame in order to position the spiking guns directly over the proper holes. Accordingly, various prior art machines use a spiker which is mounted to move relative to the vehicle main frame. However, since the gauge sensing devices have heretofore been mounted upon the vehicle frame, the distance between the spiking guns and the gauge sensor or measuring device is variable depending upon the position of the spiker relative to the main frame. Accordingly, the accuracy of the measurement may vary significantly.

A further problem common to many prior art machines is that they lack flexibility. That is, they are adapted to run in a prescribed sequence and major efforts are required in order to change the sequence.

Another problem common to many prior art spiking and gauging machines is that a careless operator can spike a rail into an improper gauge without any hindrance from the machine. That is, if the operator simply fails to view the gauge meter, he may spike the rail in place even though the gauge is improper.

SUMMARY OF THE INVENTION

Accordingly, it is a primary object of the present invention to provide a new and improved railroad measuring, gauging, and spiking apparatus.

A more specific object of the present invention is to provide a railroad measuring, gauging, and spiking apparatus wherein the gauge is measured at or immediately adjacent to the point of spiking.

Another object of the present invention is to provide a railroad measuring, gauging, and spiking apparatus wherein the rails may be quickly brought into gauge and spiked in proper gauge.

Yet another object of the present invention is to provide a railroad measuring, gauging, and spiking apparatus which need not rely upon operator viewing a gauge meter to ensure accuracy at each gauging point.

A still further object of the present invention is to provide a railroad measuring, gauging, and spiking apparatus which may be easily calibrated to provide highly accurate gauging.

A still further object of the present invention is to provide a railroad measuring, gauging, and spiking apparatus which is highly flexible such that its sequence of operations may be easily changed.

Yet another object of the present invention is to provide a railroad measuring, gauging, and spiking apparatus with a highly sophisticated control system especially well adapted to operate under the harsh (dust, humidity, and electromagnetic noise) environment typical for a railroad machine.

The above and other objects of the present invention which will become apparent as the description proceeds are realized by a railroad measuring, gauging, and spiking apparatus operable to bring the distance between rails to a desired gauge. The apparatus comprises: a frame; a first rail feeler mounted to the frame for contacting one of a pair of rails; second and third rail feelers mounted to the frame for contacting the other of the pair of rails at two different locations, the first rail feeler being movable with respect to at least one of the second and third rail feelers; a sensor for detecting the relative position of the first rail feeler with respect to at least one of the second and third rail feelers, the sensor outputting a sensor output representative of the gauge of the rail; a gauging mechanism operable to change the distance between the pair of rails, the gauging mechanism including inboard pushing means for increasing the separation between the rails and outboard pushing means for decreasing the separation between the rails; a gauge setter for setting the desired gauge of the rails; a feedback control circuit operable to receive the sensor output and operable to compare the actual gauge of the rails with the desired gauge of the rails as set on the gauge setter and operable to control the gauging mechanism to automatically bring the rails into the desired gauge; and a spiker for spiking at least one rail into position after the gauging mechanism has brought the rails to proper gauge. The sensor output is representative of the gauge of the rails at a point intermediate the two different locations and the spiker is located intermediate the two different locations. The frame is a spiker carriage frame mounted on a vehicle chassis and the spiker is mounted on the spiker carriage frame. The spiker carriage frame is movable with respect to the vehicle frame. Each of the first, second, and third rail feelers is a wheel, the first rail feeler mounted for sliding relative to the spiker carriage frame and disposed intermediate the two different locations, and the spiker includes two spiking guns, each spiking gun being separately movable with respect to the spiker carriage frame. The second and third rail feelers are fixed to the spiker carriage frame such that the spiker carriage frame follows the other of the two rails to maintain the spiking guns in line with holes into which the spiking guns inserts spikes. The feedback control circuit includes a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge, and a microprocessor operable to cause the gauge mechanism to operate in one direction until receiving the beyond-gauge signal, at which point, the microprocessor is operable to cause the gauging mechanism to operate in the other direction and stop upon receiving the at-gauge signal from the signal processing circuit. The apparatus further includes a sensing cylinder having a piston therein, one of the sensing cylinder and the piston being fixed relative to the frame and the other of the sensing cylinder and piston being slidable relative to the frame and supporting the first rail feeler, the sensing cylinder and piston operable to bias the first rail feeler away from the second and third rail feelers by pressurized fluid within the sensing cylinder, and the sensor is disposed within the sensing cylinder. The sensor output is representative of the gauge of the rails at a gauge point and the gauge point is closer to the spiker than it is to the gauging mechanism. The outboard pushing means includes two outer jaws operable to push against rail webs by activation of a horizontal cylinder and said inboard pushing means includes two inner jaws operable to push against rail webs by activation of an inboard cylinder.

The present invention may alternately be described as a railroad measuring, gauging, and spiking apparatus for bringing the distance between rails to a desired gauge and comprising: a frame; a sensor mounted to the frame and having a sensor output representative of the distance between a pair of rails; a gauging mechanism operable to change the distance between the pair of rails, the gauging mechanism including inboard pushing means for increasing the separation between the rails and outboard pushing means for decreasing the separation between the rails; a gauge setter for setting the desired gauge of the rails; a spiker for spiking at least one rail into position after the gauging mechanism has brought the rails to proper gauge; a feedback control circuit operable to receive the sensor output and operable to compare the actual gauge of the rails with the desired gauge of the rails as set on the gauge setter and operable to control the gauging mechanism to automatically bring the rails into the desired gauge, the feedback control circuit including; a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge, and a gauge controlling circuit operable to cause the gauging mechanism to operate in one direction until receiving the beyond-gauge signal at which point the gauge controlling circuit is operable to cause the mechanism to operate in the other direction and stop upon receiving the at-gauge signal from the signal processing circuit. The sensor output is representative of the gauge of the rails at a gauge point and the gauge point is closer to the spiker than it is to the gauging mechanism. The gauge controlling circuit is a microprocessor. The apparatus further includes a meter connected to the signal processing circuit and wherein the signal processing circuit is connected to receive a meter cal in signal operable to calibrate the meter and a servo cal in signal operable to calibrate a servoloop including the sensor and the gauging mechanism, and the signal processing circuit outputs an actual gauge signal, a desired gauge signal and an error signal. The error signal is fed to a servovalve which controls one of the outboard pushing means and the inboard pushing means. The signal processing circuit is programmable and includes an input multiplexer and an output demultiplexer. The microprocessor receives an input from a gauger switch which is disposable in an up position and in a down position and the microprocessor is operable to raise and lower the gauging mechanism depending on the position of the gauger switch. The microprocessor outputs an OK TO SPIKE signal when the rails are at gauge and the spiker will not spike until the OK TO SPIKE signal has been output.

The present invention may alternately be described as a railroad measuring, gauging, and spiking apparatus operable to bring the distance between rails to a desired gauge comprising: a frame; a sensor mounted on the frame having a sensor output representative of the distance between a pair of rails at a gauge point; a gauging mechanism operable to change the distance between the pair of rails, the gauging mechanism including inboard pushing means for increasing the separation between the rails and outboard pushing means for decreasing the separation between the rails; a gauge setter for setting the desired gauge of the rails; a feedback control circuit operable to receive the sensor output and operable to compare the actual gauge of the rails with the desired gauge of the rails as set on the gauge setter and operable to control the gauge mechanism to automatically bring the rails into the desired gauge; and a spiker for spiking at least one rail into position after the gauging mechanism has brought the rails to proper gauge; and wherein the gauge point is closer to the spiker than it is to the gauging mechanism.

The present invention may alternately be described as a railroad measuring, gauging, and spiking apparatus operable to bring the distance between rails to a desired gauge comprising: a spiker carriage frame movably mounted to a vehicle frame; a sensor mounted to the spiker carriage frame and having a sensor output representative of the distance between a pair of rails at a gauge point; a gauging mechanism operable to change the distance between the pair of rails, the gauging mechanism including inboard pushing means increasing the separation between the rails and outboard pushing means for decreasing the separation between the rails; a gauge setter for setting the desired gauge of the rails; a feedback control circuit operable to receive the sensor output and operable to compare the actual gauge of the rails with the desired gauge of the rails as set on the gauge setter and operable to control the gauging mechanism to automatically bring the rails into the desired gauge; and a spiker for spiking at least one rail into position after the gauging mechanism has brought the rails to proper gauge; and wherein the spiker is mounted on the spiker carriage. The apparatus further includes: a meter connected to the signal processing circuit to display rail gauge; a meter calibrator inputting a meter cal in signal to the signal processing circuit; and a servo calibrator inputting a servo cal in signal to the signal processing circuit; and wherein the meter calibrator is adjustable to change the meter cal in signal such that the meter is properly calibrated to display one or more outputs from the signal processing circuit, and the servo calibrator is adjustable to change the servo cal in signal such that the servoloop constituted by the sensor, feedback control circuit, and gauging mechanism is properly calibrated.

BRIEF DESCRIPTION OF THE DRAWINGS

The above and other features of the present invention will best be understood when considered with the following detailed description in conjunction with the drawings in which like characters represent like parts throughout the several views and in which.

DETAILED DESCRIPTION OF THE PREFERRED EMBODIMENTS

Figure 1:
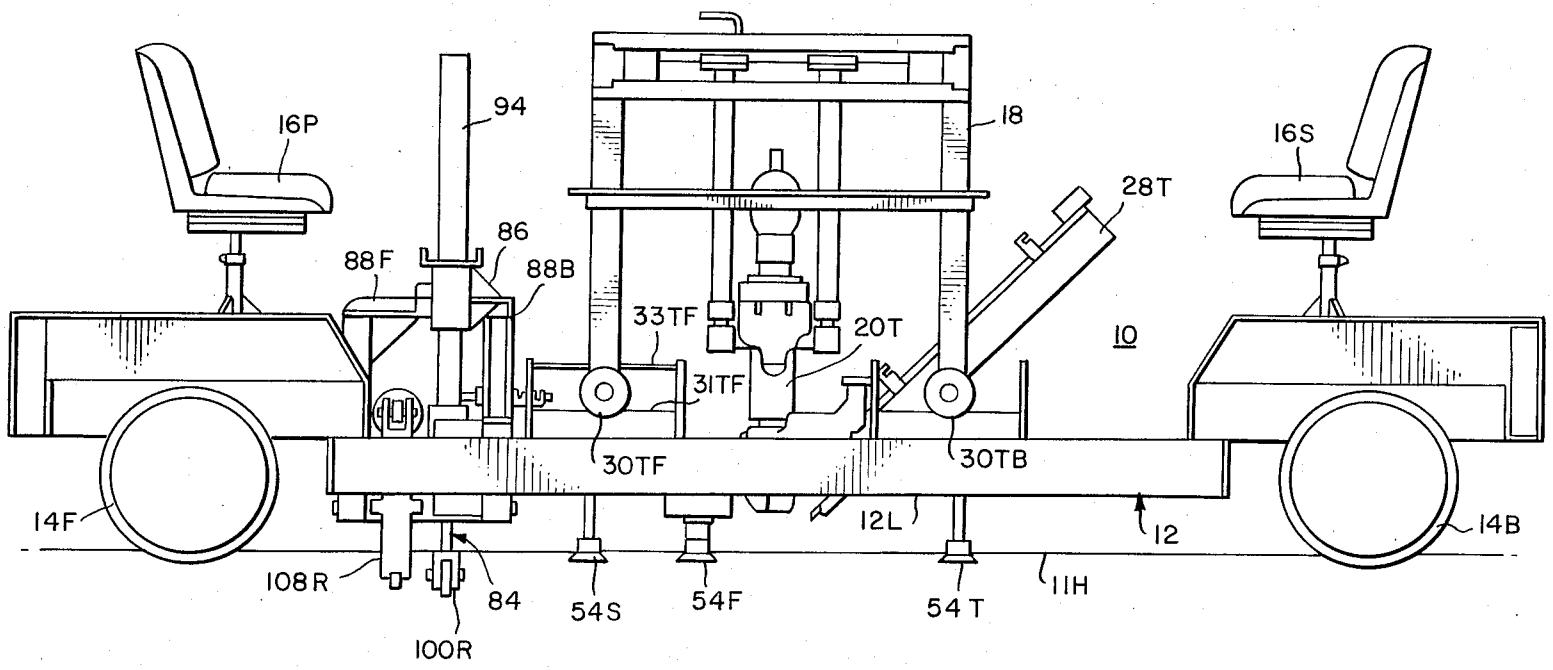
FIG. 1 shows a simplified side view of the mechanical parts of the present invention.
Figure 2:
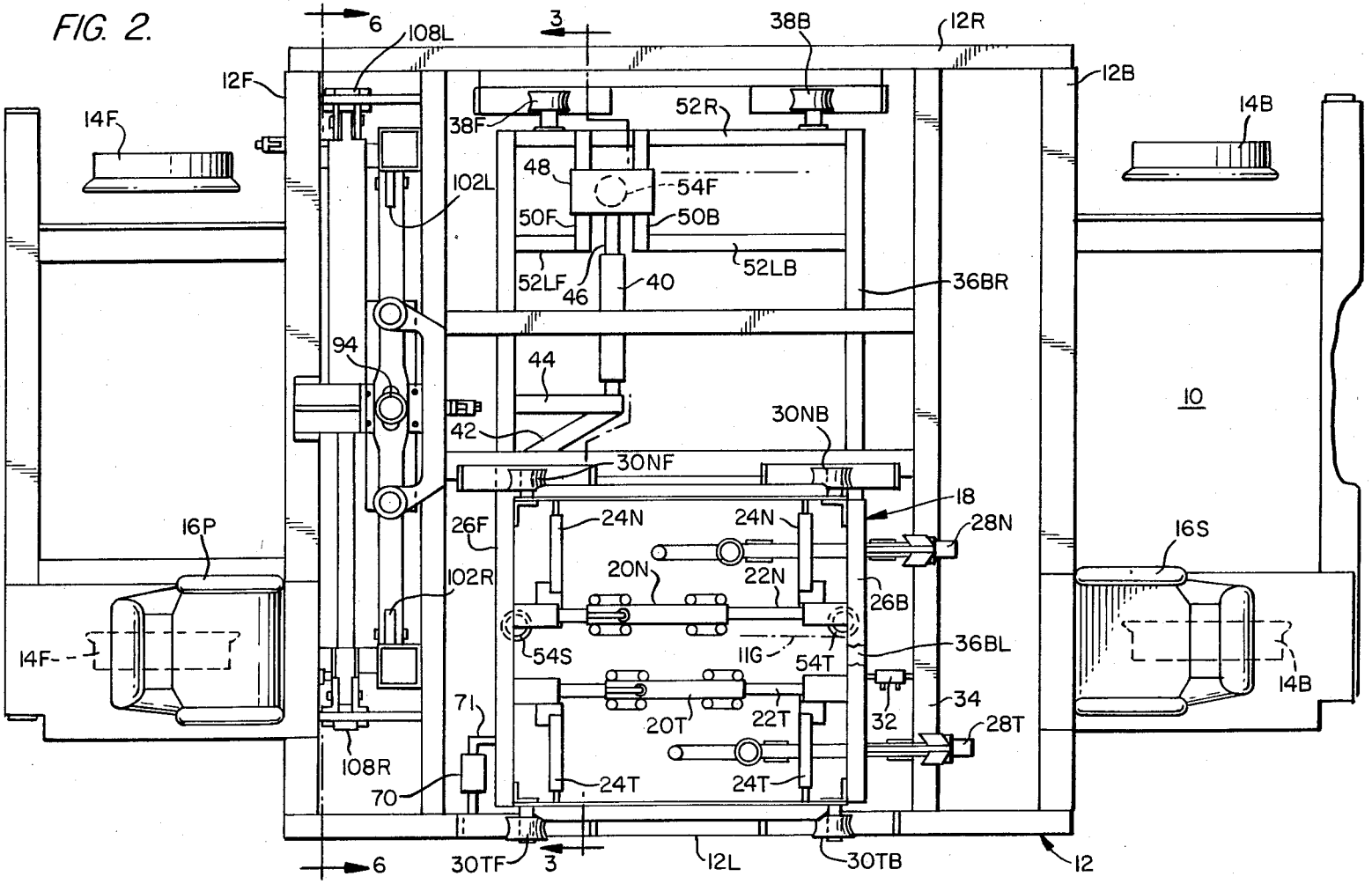
FIG. 2 shows a simplified top view of the mechanical parts of the present invention.

Turning initially to the top view of FIG. 1 and the side view of FIG. 2, the generally mechanical structure of the measuring, gauging, and spiking apparatus 10 accordingly to the present invention. Both of these views are somewhat simplified in that a diesel drive motor, power supplies, a compressor, and tubes for carrying pressurized fluid have been deleted from these views. Such components are well known in the art and need not be described in detail since the specifics of these components are not central to the present invention.

The apparatus 10 according to the present invention includes a main chassis 12 and front wheels 14F and back wheels 14R. Mounted upon the chassis 12 are an operator's seat 16P and a spike loader's seat 16S. Line 11H indicates the horizontal position of the top of the rails on which machine 10 travels. For simplicity, the details of the mounting of wheels 14F and 14B on chassis 12 are not shown.

Mounted in between the operator's seat 16P and the spike loader's seat 16S is a spiking carriage frame 18. Outboard spiking gun 20T and inboard spiking gun 20N are adjustably mounted to members 22T and 22N respectively. As is well known in the art, the spiking guns 20T and 20N may be slid back and forth along respective members 22T and 22N depending upon the spiking pattern. Additionally, the spiking guns 20T and 20N may be adjusted right or left by adjustors 24T and 24N causing corresponding movement of members 22T and 22N along front and back members 26F and 26B. Outboard and inboard spike chutes 28T and 28N are mounted to the spiker carriage frame 18 for respective cooperation with spiking guns 20T and 20N.

The spiking carriage frame 18 is mounted on the main chassis 12 by wheels 30TF, 30TB, 30NF, and 30NB.

Additionally, a hydraulic cylinder 32 (shown in FIG. 2 only) is connected between the spiker carriage 18 and the cross bar 34 which is part of the main chassis 12. Wheels 54S and 54T extend below members 26F and 26B on the spiker carriage frame 18. A hydraulic cylinder connector 70 (FIG. 2 only) is used to draw spiker carriage 18 towards the left side of chassis 12 such that wheels 54S and 54T line up to gauge line 11G representing the inside of the left rail. The cylinder 70 is shown between spiker carriage 18 and left side members 12L, but one or more such cylinders may be used in various locations to align the spiker carriage 18 with respect to the left rail. Note that the left end of the cylinder 70 shaft should be slidably connected to 12L to allow cylinder 70 to move with spiker carriage 18 as it moves relative to chassis 12.

The parts which have been discussed so far are generally known in the art and a detailed discussion is therefore unnecessary. However, a brief discussion of the operation of these parts will be helpful before proceeding with the important features of the present invention.

The operator sitting in seat 16P drives the apparatus 10 such that the spiking guns 20N and 20T are near a tie plate which is to be spiked into position. The person sitting in seat 16S loads spikes in the spike chutes 28T and 28N. If the operator stops the apparatus 10 such that the spiking guns 20T and 20N are in the proper position, he may simply actuate the spiking guns 20T and 20N to hammer spikes into the tie plate (not shown) by hydraulic hammers in the spiking guns. The spiking guns are operable to remove a single spike from the bottom of the spike chutes 28T and 28N and hammer it into place. On the other hand, if the apparatus 10 is not stopped in exactly the correct position, the operator may actuate hydraulic cylinder 30 (or other similar mechanisms) to cause the spiking carriage frame 18 to move relative to the main chassis 12. The spiking carriage frame 18 may roll along wheels 30TF, 30TB, 30NF, and 30NB until the spiking guns 20T and 20N are in proper position over the tie plate holes. Since each of the spiking guns 20T and 20N are adjustably fixed to the spiking carriage frame 18, the spiker may be set to spike in differing patterns. If desired, lights (not shown) may be mounted on the spiking carriage and/or main chassis frame 12 to aid the operator by illuminating the tie plate holes.

Gauge Sensor Arrangement

Continuing to consider FIGS. 1 and 2, but also considering the simplified cross section view of FIG. 3 taken along lines 3—3 of FIG. 2, the sensing arrangement of the present invention will be discussed in detail. The simplified cross section view of FIG. 3 leaves out the upper portion of the spiking carriage 18 and the spiking guns 20T and 20N among other parts.

Figure 3:
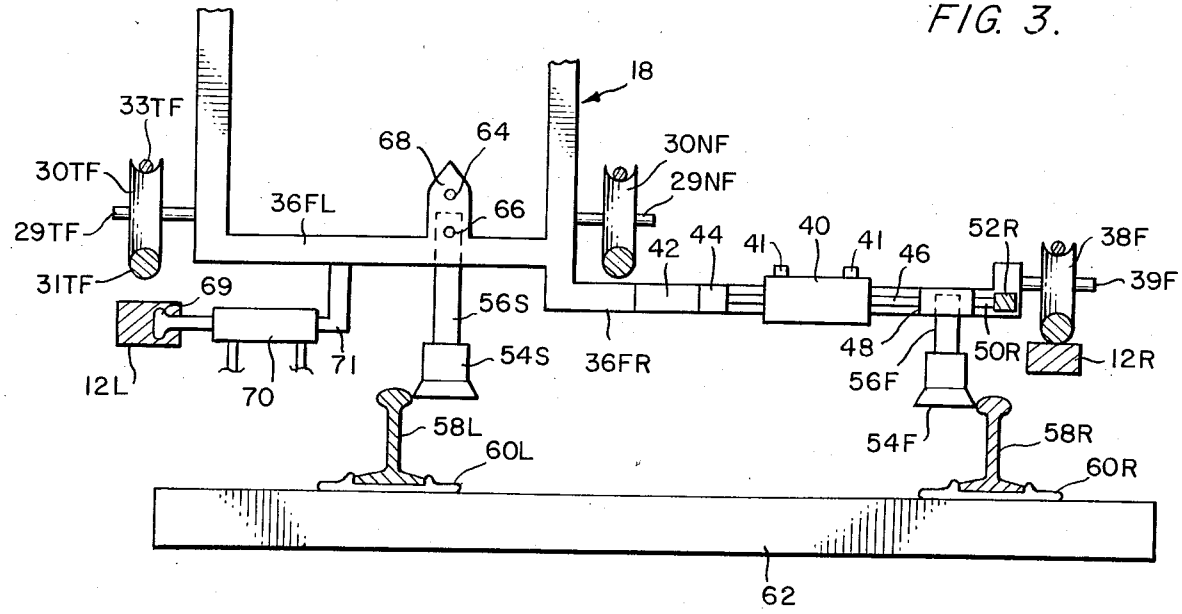
FIG. 3 is a simplified cross section view taken along lines 3—3 of FIG. 2.

The spiking carriage frame 18 includes front and back cross bars 36FL and 36BL, only 36FL being visible in FIG. 3. Since the cross bars 36FL and 36BL are disposed directly beneath the members 26F and 26B they are not visible in FIG. 2. As best shown in FIG. 3, the spiker carriage 18 may move normal to the plane of FIG. 3 by spiker carriage wheels 30TF and 30NF moving along their respective supports 31TF and 31NF which are fixed to the main chassis frame 12. Wheels 30NB and 30TB (FIGS. 1 and 2) would, of course, move at the same time. The wheels such as 30TF are mounted on tube wheel supports such as 31TF and locked in place by an overhead wheel capture rod such as 33TF. Note that rod 29TF mounting wheel 30TF allows spiker carriage 18 to move right to left relative to chassis 12 to which wheel support 31TF and capture rod 33TF are fixed.

At the right side of the cross bar 36FL is a cross bar 36FR. This cross bar 36FR is horizontally extending parallel to cross bar 36FL and just below cross bar 36FL. Cross bar 36FR is integral with or otherwise fixed to cross bar 36FL, thereby effectively constituting an extension of the spiker carriage 18. Likewise, a back right cross bar 36BR constitutes an extension of a back left cross bar 36BL (shown only in FIG. 2 below the broken away portion of part 26B).

In order to allow the right side cross bars 36FR and 36BR to move back and forth as an extension of the spiker carriage 18, front and back wheels 38F and 38B are disposed at the right sides of the cross bars 36FR and 36BR. As shown, the wheels 38F and 38R are rotatably secured to the vehicle chassis 12 in the same fashion as discussed above with respect to spiker carriage wheel 30TF and the wheels 30TB, 30NF, and 30NB.

A pneumatic cylinder 40 is mounted to the cross bar 36FR by way of members 42 and 44. Extending from the right end of the pneumatic cylinder 40 is a shaft 46. As best shown in FIG. 2, shaft 46 is attached to a support block 48 adapted to slide along slide rods 50F and 50B. Slide rods 50F and 50B extend between right support member 52R and front and back left support members 52LF and 52LB. Shaft 46 may thus move relative to the parts 52LF and 52LB and other parts of the spiker carriage 18 as block 48 slides from right to left along slide rods 50F and 50B. Below support block 48 is a first rail feeler wheel 54F rotatably mounted to shaft 56F. The support block 48 preferably includes a hole into which the upper part of shaft 56F may be inserted and pinned into place.

As shown in FIG. 3, the rail feeler wheel 54F is positioned to contact the gauge point on the right rail 58R mounted on right tie plate 60R on the rail tie 62.

Instead of having the rail feeler wheel 54F being adapted for pinning to the support block 48, a pneumatic cylinder (not shown) could be used for biasing the gauging wheel 54F downwardly. Additionally, a cam following mechanism could be used to follow the top of the rail 58R such that wheel 54F would ride up and down with irregularities in the level of the rail 58R.

In addition to the first rail feeler wheel 54F slidably mounted to the spiker carriage frame 18, the second and third rail feeler wheels 54S and 54T are fixed into position on the spiker carriage fram 18. Since both of these rail feeler wheels are mounted in similar fashion, it will suffice to discuss the mounting arrangement for the second rail feeler wheel 54S best shown in FIG. 3. The rail feeler wheel 54S is rotatably secured to shaft 56S which is pinned to the cross bar 36FL. As shown in FIG. 3, a flange 68 which extends upwardly from cross bar 36FL includes an upper hole 64 into which a hole 66 in shaft 56S may be pinned such that the second rail feeler wheel 54S is removed from and above the left rail 58L. The shaft 56S as shown in FIG. 3 is pinned to a lower hole (behind hole 66) such that the rail feeler wheel 54S contacts the gauging point of the rail 58L. The third rail feeler wheel 54S is mounted to cross bar 36BL in similar fashion to the mounting of wheel 54S to cross bar 36FL.

The hydraulic cylinder 70 is attached between the main chassis left support member 12L and a downwardly extending portion 71 of the spiker carriage 18.

When the hydraulic cylinder 70 is supplied with pressurized fluid, a piston therein (not shown) moves spiker carriage 18 (see especially FIG. 3) as leftmost as possible such that the second and third rail feeler wheels 54S and 54T are touching the left rail 58L at the ball on the rail head of rail 58L. As shown at 69, cylinder 70 is designed to slide relative member 12L. Any of a number of arrangements could be used such as having a head 69 which slides in a complimentary track in member 12L. Also, more than one cylinder could be used between spiker carriage 18 and chassis 12. As best appreciated by considering FIG. 2, the second and third rail feeler wheels 54S and 54T will be touching the rail 58L (not shown in FIG. 2) at different locations along its length.

Figure 5:
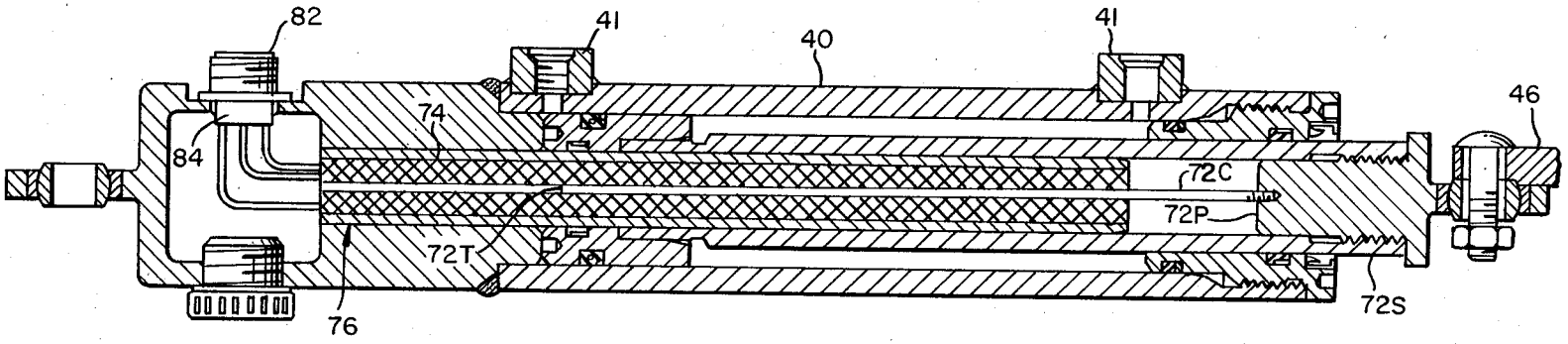
FIG. 5 is a cross section view of a linear variable differential transformer as used with the present invention.
Figure 4:
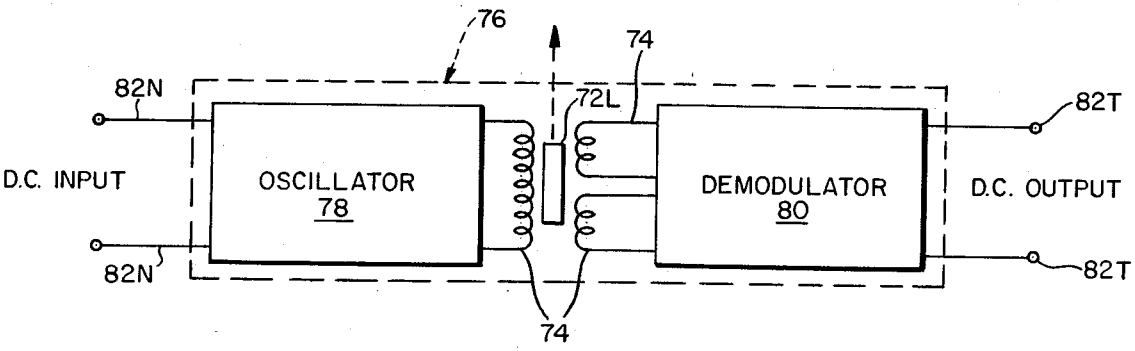
FIG. 4 is a circuit diagram to illustrate the operation of a linear variable differential transformer sensor as used with the present invention.

Turning now to FIGS. 4 and 5, the details of the pneumatic cylinder 40 will be discussed. FIG. 4 shows the electronic structure within sensing cylinder 40, whereas FIG. 5 is a cross section view of the pneumatic cylinder 40. The pneumatic cylinder 40, which functions as a sensing cylinder includes a piston 72P which is fixed to a sleeve 72S for common movement. A core 72C is fixed to the rod end or piston 72P for movement therewith. As shown, the piston 72P is bolted to the shaft 46 which is shown broken away in FIG. 5, but shown completely in FIGS. 2 and 3.

The core 72C extends to a tip 72T which extends into the coils 74 of a linear variable differential transformer (LVDT) 76. One of the coils 74 is connected to an oscillator 78 and two of the coils 74 are connected to a demodulator 80 (FIG. 4). The oscillator 78 and demodulator 80 may be built into the pneumatic cylinder 40 at or below the lower portion 84 of connector 82. The connector 82 may then be supplied with input power to the oscillator 78 at terminals 82N and the output at terminals 82T may be provided to connector 82. Alternately, the three coils 74 may have outputs which extend out to an oscillator and demodulator outside of the pneumatic cylinder 40. However, LVDT assemblies commonly include the oscillator and demodulator built in and it is therefore advantageous to have the oscillator 78 and demodulator 80 included within the pneumatic cylinder 40.

Considering now FIGS. 1–5, a brief overview of the operation of the LVDT assembly 76 will be presented. Specifically, as the apparatus 10 rolls down the track, the hydraulic cylinder 70 (either alone or in combination with one or more other hydraulic cylinders) moves the spiker carriage frame 18 as close as possible to the left chassis support member 12L. Note that the axles such as 29TF, 29NF, and 39F are movable relative to their respective spiking carriage wheels. That is, the spiker carriage 18 may move leftwardly without moving its wheel 30TF to the left since the axle 29TF is slidably disposed within the wheel 30TF. Accordingly, the spiker carriage frame 18 moves leftwardly until the rail feeler wheels 54S and 54T are disposed right up against the side of rail 58L. By simultaneously supplying the pneumatic cylinder 40 with pressurized fluid through the port or ports 41, the piston 72P (see especially FIG. 5) will be displaced rightwardly until the first rail feeler wheel 54F (FIG. 3) is disposed up against the right rail 58R. Variations in the track gauge will result in the LVDT core 72C moving back and forth relative to the coil 74. The DC output at terminal 82T of the demodulator 80 will thus vary depending upon the gauge of the rail.

Concentrating now on the top view of FIG. 2, an especially advantageous feature of the present invention will be discussed. In particular, the use of the three rail feeler wheels 54F, 54S, and 54T causes the LVDT 76 to output a signal proportional to the gauge of the rail immediately adjacent to the position of the spiking guns 20T and 20N. The two rail feeler wheels 54S and 54T will line up the spiker carriage frame 18 with respect to the left rail 58L (shown in FIG. 3 only) as is done in a prior art spiker machine which lacks a gauger. Since the sliding rail feeler wheel 54F is disposed intermediate the locations of the fixed rail feelers 54S and 54T, the LVDT 76 within the pneumatic cylinder 40 will output a sensor output based upon the gauge of the rails intermediate to the fixed rail feeler wheels 54S and 54T. Thus, the measured gauge will be taken much closer to the spiking guns 20N and 20T than typical for prior art machines.

Note that if the brace 42 extended slightly further to the right in FIG. 2, the sensing cylinder 40 with its interior LVDT 76 could yield a gauge exactly where the spiking guns are located. However, since the two spiking guns 20T and 20N are independently adjustable relative to the spiking carriage 18, gauging at the same point (line transverse to the rails) as one spiking gun might still be slightly displaced with respect to the other spiking gun. Moreover, the preferred embodiment of the present invention may also include a vertically extending hydraulic cylinder (not shown) which is approximately centrally located within the main chassis 12 and used to turn around the present apparatus 10. Such turn table arrangements are well known in the art and are not central to the present invention. However, because it is desirable to locate such vertically extending turn table hydraulic cylinders centrally to the apparatus 10, the sensing pneumatic cylinder 40 is disposed slightly to the left of transverse lines extending from the spiking guns 20T and 20N. Obviously, it is contemplated by the present invention that the member 42 may be extended slightly further such that the sensing cylinder 40 is located immediately across from the spiking guns 20T and 20N.

As is mentioned above, the spiker carriage frame 18 may move to the right and left (see especially FIG. 3) relative to the main frame 12 including support members 12R and 12L. It should also be noted that the construction of the spiker carriage wheels such as 30TF, 30NF, and 38F allow the spiker carriage 18 to be slightly angularly displaced relative to the main frame chassis 12. In particular, and considering wheel 30TF in FIG. 3, the spiker carriage 18 may be slightly angularly disposed relative to the main chassis 12 if the rail 58L places a torque on the two rail feeler wheels 54S and 54T. Because of the way the spiker carriage wheel 30TF (and other similar wheels) are captured between portions 31TF and 33TF, the spiker carriage frame 18 may rotate about a vertical axis slightly with respect to the main chassis 12.

Gauging Mechanism

Figure 6:
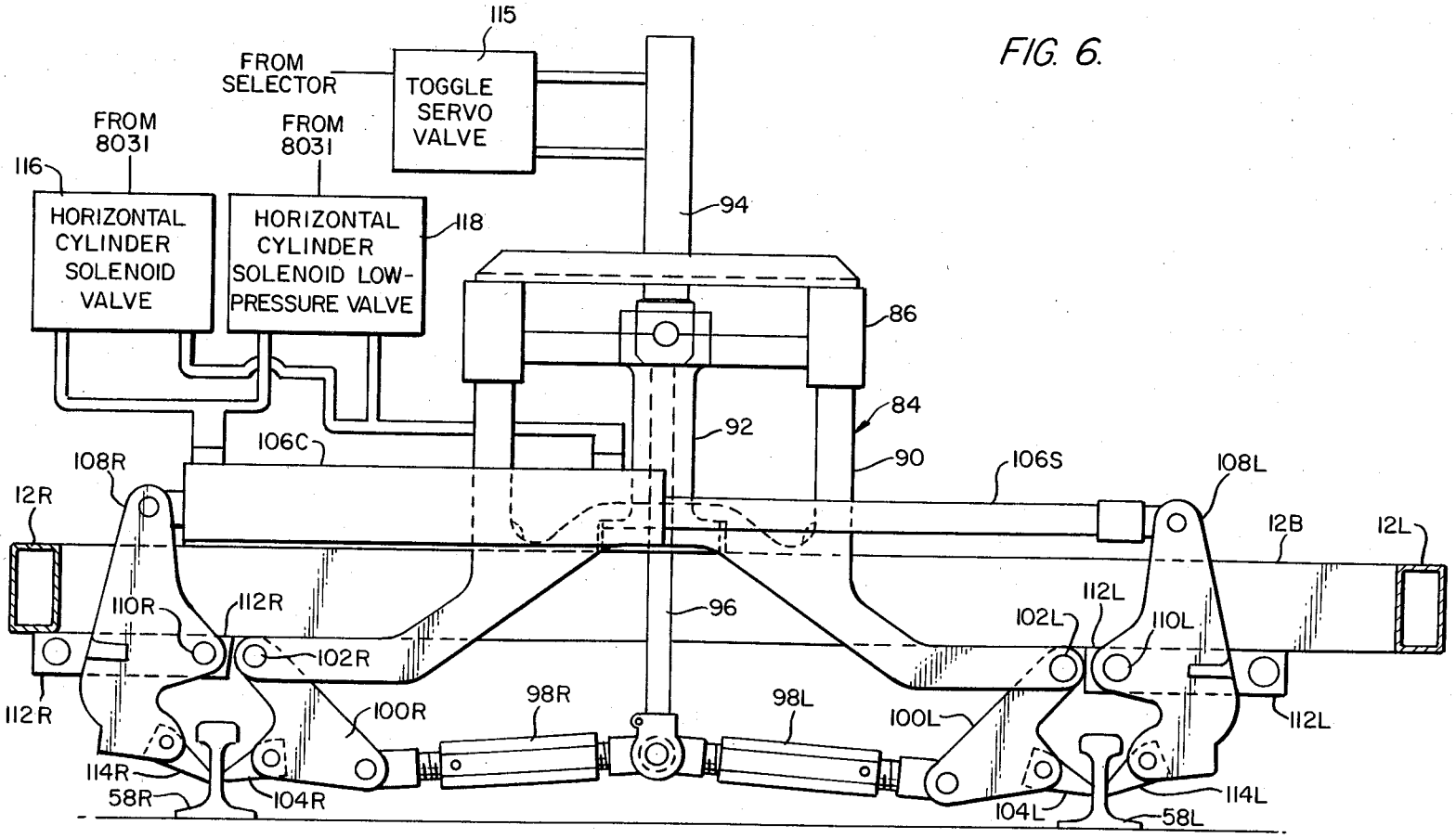
FIG. 6 is a simplified cross section view as taken along lines 6—6 of FIG. 2.

Viewing FIG. 6 in conjunction with FIGS. 1 and 2, the gauging mechanism 84 will now be discussed in detail. FIG. 6 shows a simplified cross section view taken along lines 6—6 of FIG. 2. Additionally, FIG. 6 includes a schematic representation of several valves which are used to control the gauging mechanism 84.

The main chassis 12 includes front and back gauger supporting members 12F and 12B. A tower casting 86 is mounted above and between the gauger support members 12F and 12B. Specifically, portions 88F and 88B extend down from the tower casting 86 to the members 12F and 12B. A jaw frame casting 90 extends downward from the tower casting 86 and in between the members 12F and 12B. A sleeve member 92 is mounted to the tower casting 86 and includes a toggle cylinder 94 mounted at its top. A shaft 96 extends out of toggle cylinder 94 to pivotably connect with right and left toggle links 98R and 98L. The opposite ends of the toggle links 98R and 98L are pivotably connected to the respective right and left inner jaw castings 100R and 100L. The upper portions of inner jaw castings 100R and 100L are respectively pivotably connected to points 102R and 102L on the jaw frame casting 90. Right and left inner jaws 104R and 104L are respectively fixed to jaw castings 100R and 100L.

As shown, the toggle links 98R and 98L are adjustable to vary the travel of the jaws 100R and 100L.

A horizontal cylinder 106C is pivotably mounted to right outer jaw casting 108R and has a shaft 106S which is pivotably mounted to left outer jaw casting 108L. The right and left outer jaw castings 108R and 108L are respectively pivotably mounted at points 110R and 110L on parts 112R and 112L which are fixed to the frame 12. Outer jaws 114R and 114L are respectively fixed into outer jaw castings 108R and 108L.

Briefly discussing the operation of the gauging mechanism 84 with reference to FIG. 6, the toggle cylinder 94 may be actuated by toggle servo valve 114 to cause the inner jaws 104L and 104R to push outwardly tending to spread the rails 58L and 58R. The inner jaws 104L and 104R constitute an inboard (inside of the rails) pushing means. A high pressure horizontal cylinder solenoid valve 116 may supply high pressure hydraulic fluid to horizontal cylinder 106C to move the outer jaws 114R and 114L. A low pressure horizontal cylinder solenoid valve 118 may also be used to supply pressure to the horizontal cylinder 106C. The outer jaws 114L and 114R constitute a outboard pushing means useful for bringing the two rails 58R and 58L closer together. In actual practice, one of the two rails will be spiked into position, whereas the other rail may be moved by operation of the gauging mechanism 84.

Feedback Control Circuit

Figure 7:
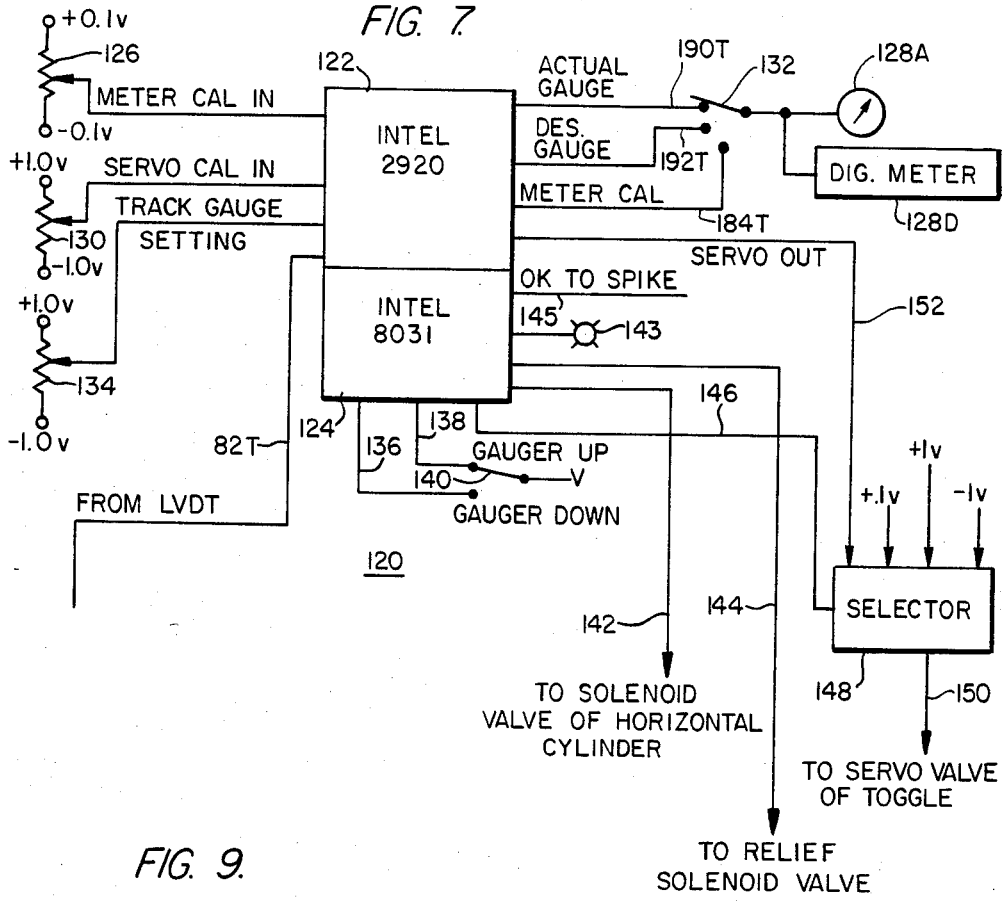
FIG. 7 is a block diagram of the electronic components of the present invention.
Figure 8:
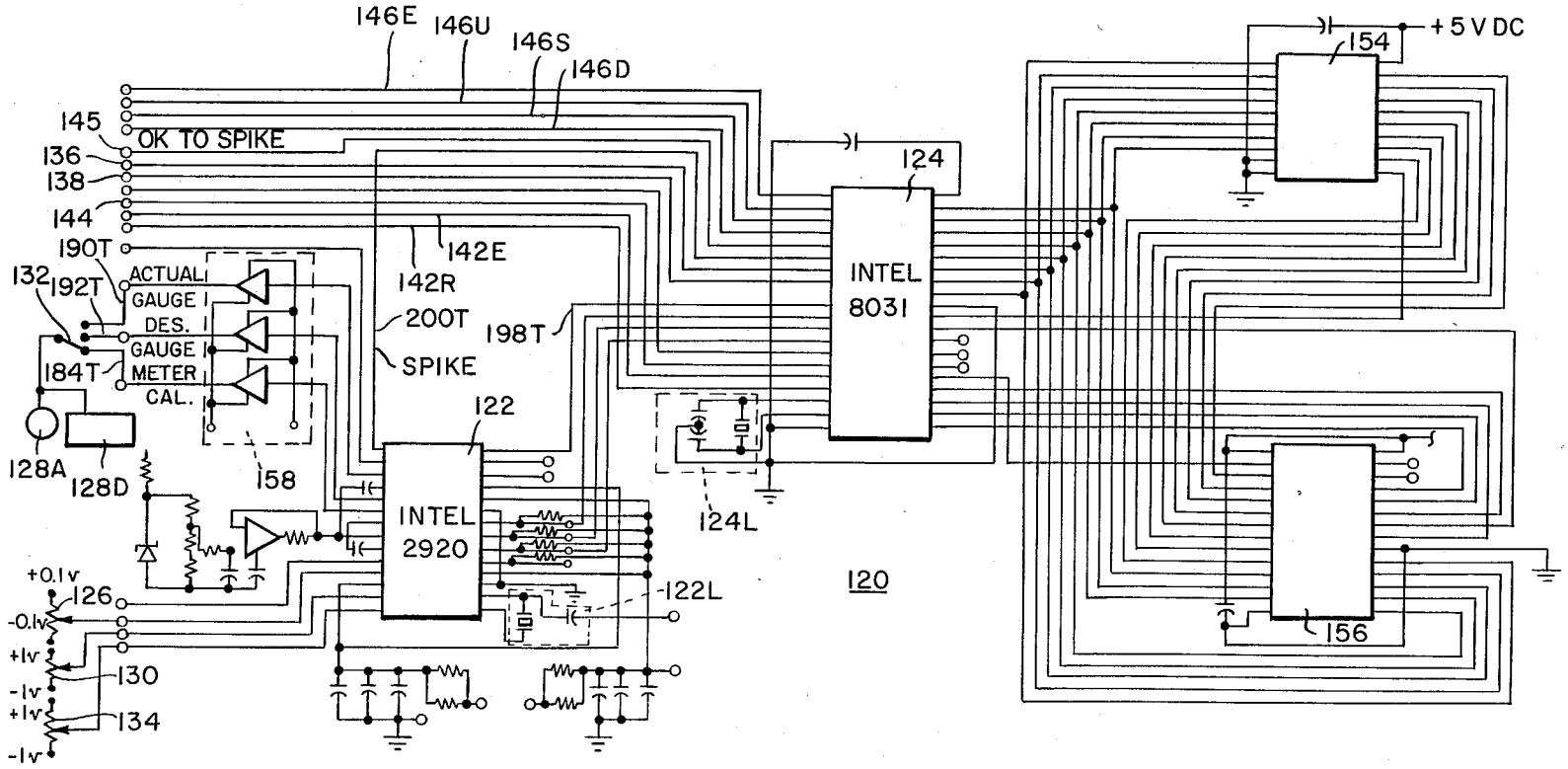
FIG. 8 is a detailed schematic of connections between various electronic components of the present invention.

Turning now to FIGS. 7 and 8, a feedback control circuit 120 as used with the present invention will be discussed. FIG. 7 shows a simplified block diagram of the feedback control circuit 120, whereas FIG. 8 shows a detailed pin diagram illustrating the electrical connections between various chips.

The feedback control circuit 120 includes a signal processing circuit 122 and a gauging mechanism control circuit 124. The signal processing circuit 122 which may preferably be realized by an intel 2920 chip generally functions to process a number of analog signals. More specifically, the intel 2920 or signal processing circuit 122 is used to compare the actual track gauge with a desired track gauge as input by the machine operator. A meter calibrator potentiometer 126 feeds a meter cal in signal into the signal processing circuit 122 in order to properly calibrate analog gauge meter 128A and digital gauge meter 128D which may receive one of several outputs from the signal processing circuit 122. A servo calibrator potentiometer 130 feeds a servo cal in signal to the signal processing circuit 122 in order to properly calibrate a servoloop including the LVDT 76, the signal processing circuit 122, and the gauging mechanism 84.

As shown, the signal processing circuit 122 includes an actual gauge output on line 190T, a desired gauge output on line 192T, and a meter cal output on line 184T which may be selectively fed to the analog meter 128A and digital member 128D depending upon the position of a selector switch 132. When the selector switch 132 is connected to the actual gauge terminal, the meters will display the actual guage of the rail as sensed by the LVDT and calibrated in the signal processing circuit 122. When the selector switch 132 is connected to the desired gauge terminal, the meters will display an output dependent upon the setting of gauge setter potentiometer 134. This potentiometer 134 sends a track gauge setting signal to the signal processing circuit to indicate the gauge which the operator wishes to have.

The meter cal signal feed to selector switch 132 is a known voltage which should produce a predetermined reading on the analog meter 128A and the digital meter 128D. For example, the meter cal would normally be 1.00 volts. When the selector switch 132 is in position to feed the meter cal signal to the meters, the digital meter should read 56.5 inches. If the digital meter 128D does not read 56.5 inches, then the meter calibrator potentiometer 126 may be adjusted to slightly change the voltage fed to the digital meber 128D such that it will read the proper value 56.5 inches. This adjusts the circuit such that the digital meter 128D accurately responds to outputs from the signal processing circuit 122.

The gauger control circuit 124, such as Intel 8031 microprocessor chip, is connected to gauger down line 136 and gauger up line 138. Depending upon the position of the gauger switch 140, a set voltage is supplied to one of these two lines. This set voltage will cause the microprocessor 124 to raise or lower the gauging mechanism 84. Depending upon the specific voltage applied to lines 136 and 138, pull up resistors or pull down resistors could be used. For simplicity sake, the gauger switch 140 is not shown in FIG. 8.

The outputs of the microprocessor chip 124 include horizontal cylinder control line 142 relief valve control line 144, and toggle cylinder control line 146. Basically, the horizontal cylinder control line 142 controls the valve 116 (FIG. 6) which in turn controls the horizontal cylinder 106C (FIG. 6). As shown in the detailed pin diagram of FIG. 8, the horizontal cylinder control line 142 may be realized by a retract control line 142R and an extend control line 142E.

The output on relief valve control line 144 is fed into the horizontal cylinder solenoid low pressure valve 118 (FIG. 6). This valve supplies low pressure to the horizontal cylinder 106 to allow it to resist outward pushing from the jaws 104R and 104L.

As shown in FIG. 8, the toggle cylinder control line 146 may comprise four separate control lines 146E, 146U, 146S, and 146D. All of these control lines are fed into an analog selector circuit 148 (FIG. 7 only) having a toggle activation line 150 as its output. Depending upon the signals on the control lines 146, the toggle activation line 150 will pass through one of four analog signals applied at its inputs. Specifically, if the toggle control line 146D is activated, the selector 148 will feed the minus one volt input to the output line 150 causing the inboard gauging jaws 104R and 104L (FIG. 6) to quickly move down. If the control line 146E is actuated, the data selector 148 will feed a servo out signal on line 152 to the output line 150. This servo out signal on line 152 constitutes an error signal output by the signal processing circuit 122 as the difference between the desired track gauge and the actual track gauge. If the control line 146U is actuated, the data selector 148 will select the plus one volt input to be fed to the output line 150, thereby quickly raising the inner jaws 104R and 104L. If the control line 146S is actuated, this places the plus 0.1 volt input on line 150, thereby maintaining the toggle cylinder 94 (FIG. 6) by slightly upwardly. This is useful to help prevent any imbalance in the toggle servo valve 115 (FIG. 6) from causing the toggle cylinder 94 to go down improperly which might result in damage to the machine or the rails. Alternately, the jaw castings 100L and 100R and even the outer jaw castings 108R and 108L may include holes for accommodating locking pins to lock them up and away from the track. Such holes are not shown in the drawings, but are well known as a means of preventing mechanisms from dropping to the rail as a machine moves along the track.

Concentrating now on FIG. 8, the components shown in FIG. 8 but not shown in FIG. 7 will be discussed. A decoder driver chip 154 connects a memory chip 156 to the microprocessor 124. The memory chip 156, which may be realized by chip TD2764, stores the controlling program for the microprocessor 124. The decoder driver chip 154, which may be realized by chip IB8282 is used to convert signal levels between the microprocessor 124 and the memory chip 156 in a manner well known in the art.

Instead of including the decoder driver chip 154 and the memory chip 156, an Intel 8051 or 8751 chip could be used for the microprocessor 124. Such an Intel chip includes a built-in memory. A clock circuit 124C is connected to the microprocessor 124.

A clock circuit 122C is connected to the analog signal processing circuit 122 to provide an internal clock. Various voltage levels and auxiliary resistors, capacitors, and other circuit components are connected to the signal processing chip 122. However, the attachment of these elements to an Intel 2920 chip is well known in the art and need not be discussed in detail. An output driver circuit 158 is connected between the analog signal processing circuit 122 and the selector switch 132. This circuit is simply used to buffer the meters 128A and 128B from the signal processing circuit 122.

Various controlled power supplies may be used to supply power to the chips shown in FIG. 8. Since none of these power supplies to central to the present invention, they need not be discussed in detail. Additionally, the outputs of the chips 122 and 124 should be compatible with the valves 115, 116, and 118 (in FIG. 6). Depending upon the specific characteristics of those valves, one of ordinary skill in the art can easily insert level adjusting circuits to ensure compatibility in the signal levels.

The internal structure of the gauge controlling circuit or microprocessor 124 is realized by an intel 8031 chip. Since a microprocessor chip such as the 8031 is a standard building block in control circuits, its internal structure need not be discussed in detail.

Figure 9:
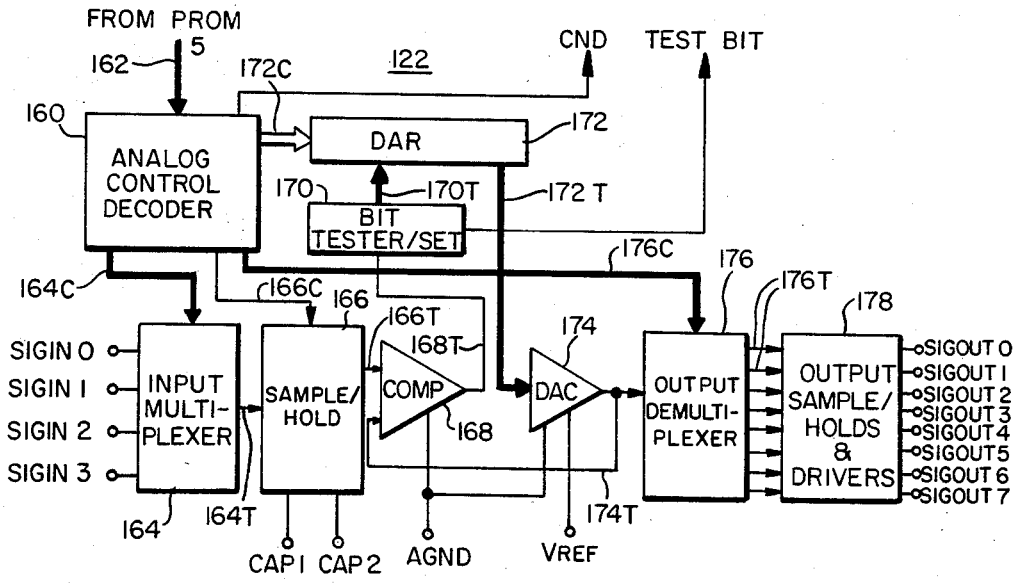
FIG. 9 is a block diagram of the signal processing chip as used with the present invention.

The internal structure of the Intel 2920 signal processing circuit 122 will presently be discussed with reference to FIG. 9. The signal processing circuit 122 includes an analog control decoder 160 which receives the instructions from a built-in PROM (not shown) on lines 162. The analog control decoder 160 controls an input multiplexer 164 by control lines 164C. Specifically, the digital signal on control lines 164C selects one of the four signals applied at the input terminals SIGIN 0, SIGIN 1, SIGIN 2, and SIGIN 3 which is passed through as an analog output on line 164T. Briefly referring back to FIG. 8, it will be noted that these four inputs correspond to the meter cal in, servo cal in, track gauge setting, and LVDT signals.

The analog control decoder 160 controls a sample and hold circuit 166 by way of control line 166C. As shown, the sample and hold circuit 166 have CAP 1 and CAP 2 terminals for connections to an external capacitor. The sample/hold circuit 166 has an analog output 166T which is feed into comparator 168. The comparator 168 has an output 168T which is fed into bit tester/-set block 170. The output of the bit tester 170 is a digital signal on lines 170T fed into the digital analog register (DAR) 172 which is controlled by control lines 172C from the analog control decoder 160. The digital output on lines 172T is fed into digital to analog converter 174 having output line 174T which feeds back an analog signal to the comparitor 168.

The digital equivalence of an input sample is computed in the DAR 172, whereas the comparator 168 allows the comparison of different input signals. For example, the comparator 168 allows one to compare the LVDT input signal at SIGIN 0 with the desired gauge signal as fed into the terminal SIGIN 1.

The output of the digital analog converter 174 on line 174T is additionally fed into output demultiplexer 176 which is controlled by control line 176C from the analog control decoder 160. The output demultiplexer 176 transfers the analog signal on line 174T to one of the eight output lines 176T from the output multiplexer 176. The output lines 176T are fed into an output sample/-hold and driver circuit 178 which functions to sample and hold the analog signals on the eight lines 176T and buffer these outputs for delivery to the shown SIGOUT terminals.

2920 Software

Figure 10:
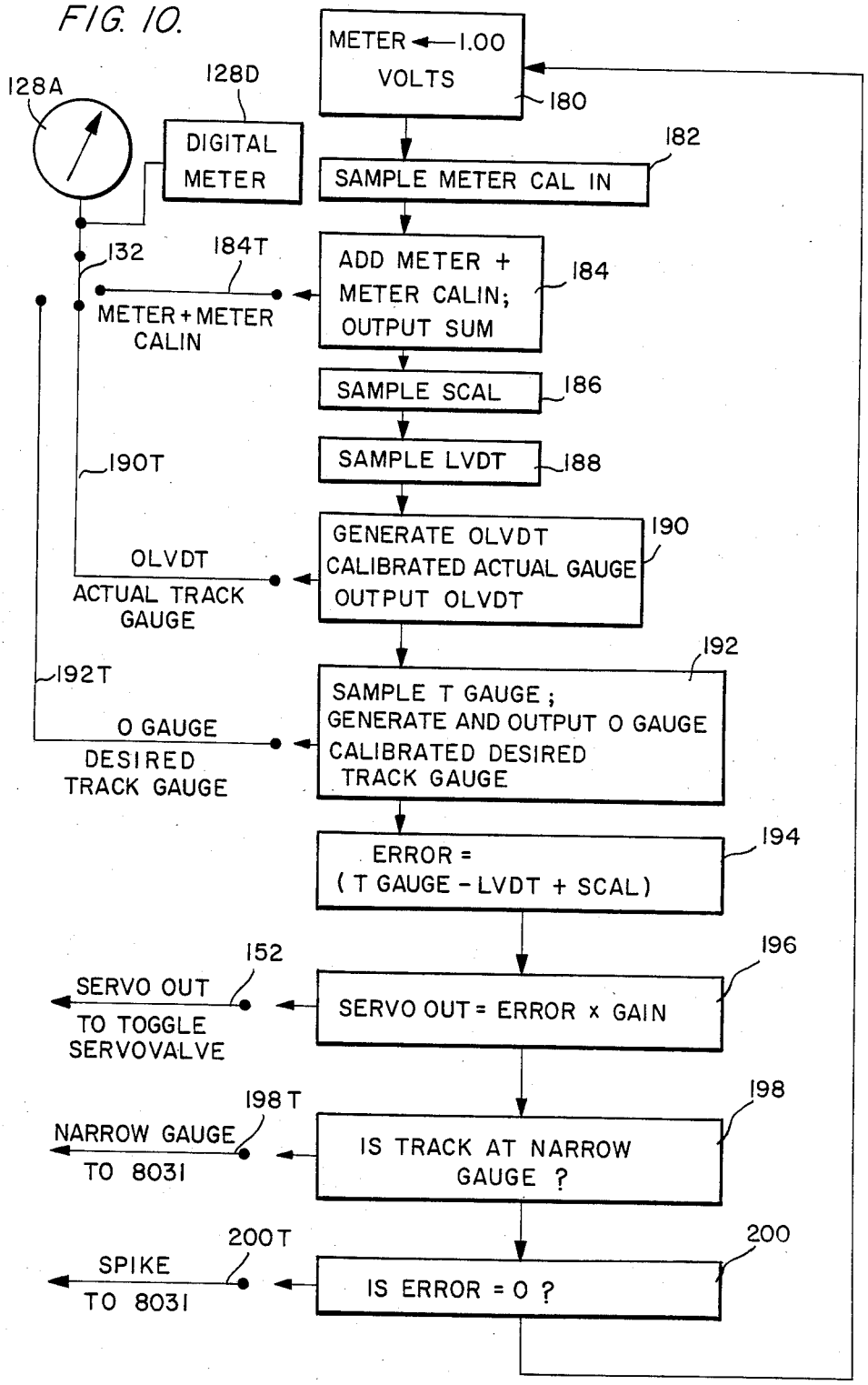
FIG. 10 is a flow chart illustrating the sequence of operations of the signal processing chip of the present invention and also schematically illustrating its connections to other parts of the present invention.

Turning now to FIG. 10, but continuing to consider FIGS. 7, 8, and 9, the software used in the signal processing circuit 122 will be discussed. FIG. 10 shows a simplified flow chart of the sequence of operations of the signal processing circuit 122 as realized by the Intel 2920 and indicates the path of outputs of the circuit 122. The sequence of operations is controlled by a programmable read only memory (PROM) which is resident within the 2920 chip. Alternately, a separate memory chip could control the sequence of operations.

In addition to showing the basic flow chart or sequence of operations of the 2920 chip, FIG. 10 also schematically illustrates various inputs and outputs of the 2920 chip to aid in the understanding of the sequence of operations of this signal processing circuit 122.

The program for the 2920 signal processing circuit 122 begins at block 180 whereat the variable meter is initialized to a value of 1.00 volts. Next, the meter cal in signal is sampled at block 182. Block 184 takes the sum of the meter signal and the meter cal in signal and outputs an analog signal corresponding to this sum at electrical line 184T shown also at FIG. 7. Note that for ease of illustration, the output buffer circuit 158 is shown only in FIG. 8 and is not included in FIG. 10.

The adjustment of the meter calibrator 126 will presently be discussed with reference to FIGS. 7 and 10. Having initialized the value of meter to 1.00 volts at block 180, the software of the 2920 chip is adapted to easily allow the calibration of the meters 128A and 128B. Specifically, the meter cal in signal may initially be set midway between its end points to provide a meter cal in signal of point 0.00 volts. Accordingly, the output at electrical line 184T will be 1.00 volts. The digital meter 128D is designed to respond to 1.00 volts with a reading of 56.50 inches which is a standard rail gauge. If the digital meter 128B does not read 56.50 inches when the selector switch 132 is connected to electrical line 184T, then the meter calibrator potentiometer 126 is adjusted such that the digital meter 128D will properly read 56.50 inches. This calibrates the Intel 2920 or signal processing chip 122 and the digital meter 128D to function properly together.

Following the block 184 in the flow chart of FIG. 10, the Intel 2920 or signal processing chip 122 samples the servo cal in signal at block 186, this signal being labeled SCAL for brevity in block 186. Next, the 2920 chip samples the LVDT signal on line 82T (FIG. 7) at block 188.

After sampling the servo cal in signal at block 186 and the LVDT signal at block 188, the 2920 software will generate a calibrated actual guage signal labeled OLVDT which is fed to electrical output line 190T (also shown in FIG. 7).

Before proceeding to describe how the calibrated actual guage OLVDT is computed, the adjustment of the servo calibrator potentiometer 130 should be discussed. The signal LVDT represents a raw input signal from the LVDT inside of the pneumatic cylinder 40 (refer back momentarily to FIG. 3) based upon the position of rail feeler wheel 54F. Obviously, if the rail feeler wheel 54F has been banged slightly or is not welded to exactly the same tolerance for all of the production models of the machines, there may be slight variations in the measured gauge. If the shaft 56F or shaft 56S has been slightly bent, this could also produce inaccuracies in the measured gauge. Accordingly, the servo calibrator potentiometer 130 is designed to compensate for any such irregularities. Basically, this servo calibrator calibrates the LVDT assembly 76 to properly function in the servo control loop including LVDT assembly 76, signal processing chip 122, and gauging mechanism 84.

Calibrating the servo calibrator is relatively straight forward and could be performed once a day or every ten or twenty miles as later experience will dictate. In particular, any of various known gauge measuring devices may be used to measure the gauge at a point in the track. Such devices may be as simple as various ruler type devices known in the art and especially adapted for measuring rail gauge. The machine 10 (FIG. 1) is then propelled such that the first rail feeler wheel 54F (FIG. 1, FIG. 3) is at the point which has just been measured. The operator may then adjust the servo calibrator potentiometer 130 until the analog and digital meters 128A and 128D correspond to the measurement of the distance between the balls of the rails which was manually measured. This adjusts the sensing system including the LVDT sensor 76 for any anomalies and, therefore, assures highly accurate reading and gauging operations.

Following the calibration procedure described above wherein the servo calibrator 130 is adjusted, the electrical output on line 190T will be the actual track gauge. In particular, the program block 190 ads the raw signal LVDT to the servo cal in signal (SCAL) to yield the signal called OLVDT which is a calibrated or actual track gauge signal. The switch 132 should therefore be in the position shown in FIG. 10 in order to display the actual track gauge as is desirable during the gauging operation.

The block 192 causes the 2920 chip to sample an input signal TGAUGE which is short for the track gauge setting fed from potentiometer 134 (FIG. 7) into the chip. Additionally, block 192 causes the 2920 chip to generate an output signal OGAUGE which is the calibrated desired track gauge. This signal OGAUGE is generated by adding the signal TGAUGE to the meter cal in signal. The output OGAUGE is fed to electrical line 192T which goes to selector switch 132.

Before proceeding to discuss the remainder of the flow chart of FIG. 10, a brief discussion of the use of the OGAUGE signal on electrical line 192T is desirable. Following the adjustments of the meter calibrator 126 and servo calibrator 130, the signal processing circuit 122 is basically ready to operate. However, the operator must indicate to the machine what the gauge of the rails should be adjusted to. This is done by adjusting the gauge setter potentiometer 134 (FIG. 7) while the selector switch 132 is positioned such that the digital meter 128D displays the desired track gauge. For example, if the operator desires that the track gauge be set at 56.25 inches, the potentiometer 134 is adjusted until the digital meter reads 56.25 inches. The operator may then switch the selector switch 132 back such that the digital meter 128D displays the actual track gauge on line 190T. Alternately, a separate meter could be used to display the desired track gauge.

Following the calculation and outputting of the desired track gauge at block 192, the error signal is calculated at block 194. In particular, this block calculates an error signal which is the difference between the desired track gauge signal TGAUGE (desired track gauge prior to addition of meter cal in signal) and subtracts the raw LVDT signal, the result then being summed with the servo cal in (SCAL) signal. At block 196, a servo out signal is calculated by multiplying the error signal by a gain factor. This gain factor may simply be used to adjust the analog output at electrical lines 152 (also appearing in FIG. 7) to a proper level for controlling the toggle servo valve 115 (FIG. 6). Alternately, an electrical level output adjusting circuit could be used to adjust the error signal. Depending upon the specifics of the toggle servovalve 115 in FIG. 6, the error signal may be directly output to valve without any necessity of adjusting its gain.

Following the output of the servo out signal at electrical line 152, the flow chart includes block 198 which tests to determine if the track is at narrow gauge. This block includes steps to compare the LVDT signal with a signal slightly less than the desired track gauge. If the actual track gauge is at or less than this narrow gauge, the 2920 chip outputs a narrow gauge signal on electrical line 198T (also shown in FIG. 8) to the microprocessor 8031 chip 124.

Regardless of whether the narrow gauge signal is output at line 198T, the block 200 tests to determine if the error signal is equal to zero. If the error signal is equal to zero, a spike signal is sent to the 8031 microprocessor on electrical line 200T (also shown in FIG. 8). Depending upon the accuracy desired, the error signal is considered equal to zero if its most significant bits are equal to zero. Since the error signal will be an eight bit digital word, we may consider it equivalent to zero even if a couple of its least significant bits are not equal to zero. Obviously, this can be adjusted in the software depending upon the degree of accuracy desired.

Regardless of whether the error signal is equal to zero at block 200, the program loops immediately back to block 180 to repeat the process. Preferably, the internal clock on the signal processing chip 122 is set such that the entire loop is run through hundreds or thousands of times a second.

Appendix 1 attached hereto is a detailed program printout to implement the flow chart of FIG. 10 on the Intel 2920 signal processing chip 122.

A highly advantageous feature of the program of FIG. 10 and the attached appendix 1 is that it has no branching. Since improper branching (program JUMP steps) caused by electromagnetic noise may result in a program failure, the simple loop of this program avoids the use of JUMP steps. It should be appreciated that the apparatus 10 includes pneumatic hammers, compressors, and numerous other sources of electromagnetic noise.

8031 Software

Figure 11:
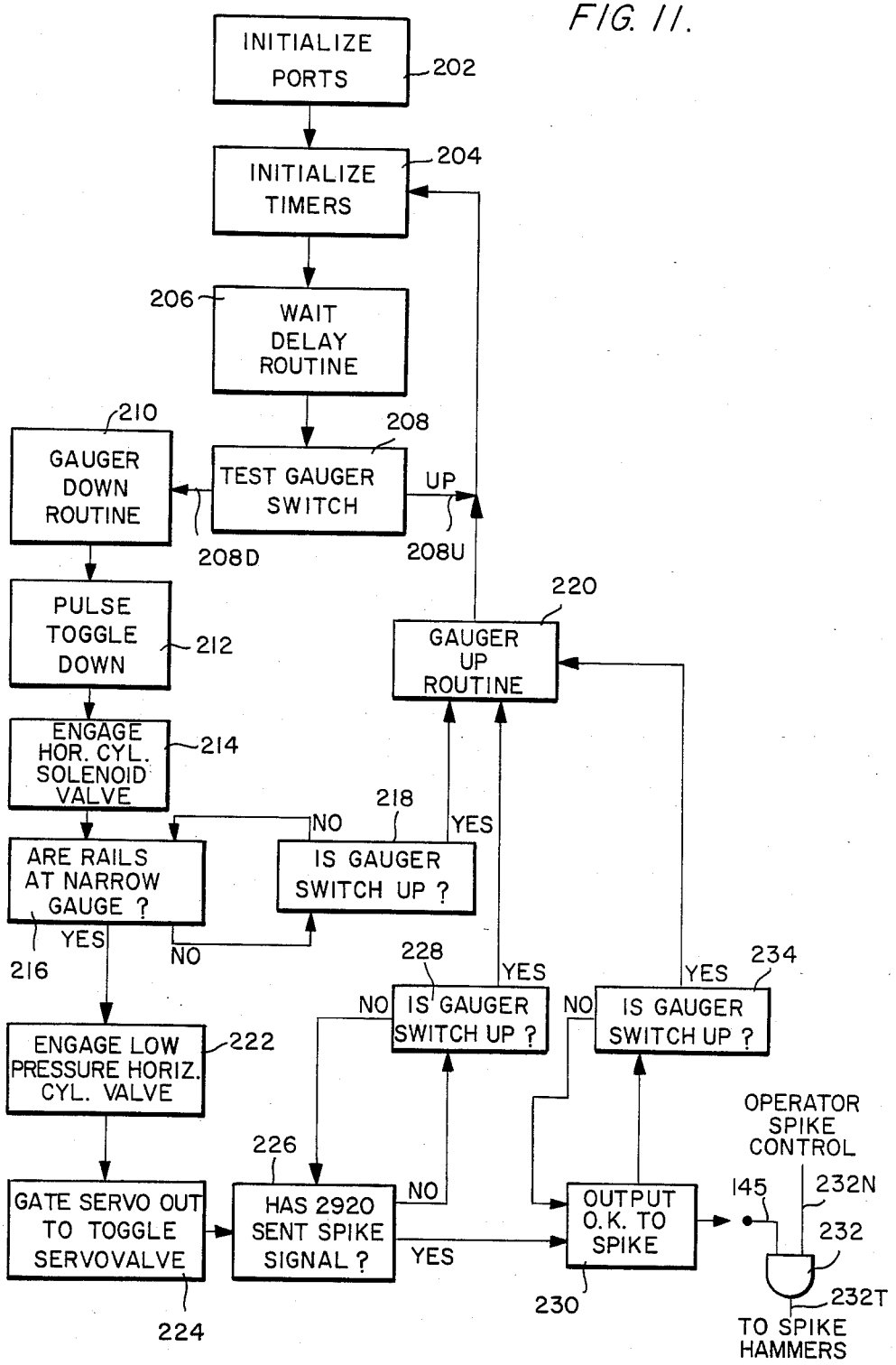
FIG. 11 is a flow chart illustrating the sequence of operations of a microprocessor used with the present invention and also illustrating its relationship to the spiker of the present invention.

Turning now to FIG. 11, a program for use with the 8031 chip in the present invention will be discussed.

The software in the 8031 microprocessor chip 124 starts with block 202 which initializes the input and output ports of the microprocessor. Next, block 204 causes the initialization of two timers within the 8031 microprocessor chip. In particular, a first timer counts down from 0.5 seconds and a second timer counts down from 5 seconds. The function of these timers will be discussed below.

Following the initialization of the timers in block 204, the program goes into a wait delay routine at block 206. Next, the gauger switch 140 (FIG. 7) is tested at block 208. If the gauger switch is in its up position, block 208 leads back to block 204 by way of line 208U. Alternately, if the gauger switch is in its down position, block 208 leads to block 210 by line 208D. Block 210 initiates a gauger down routine including the pulsing of the toggle 94 (FIG. 6) down as indicated at block 212. Basically, referring back momentarily to FIG. 6, this step actuates the toggle servo valve 115 for 0.5 seconds as measured by the first timer initialized at step 204. Considering also FIG. 7, the pulse toggle down block 212 causes control line 146 to select the minus one volt input into selector 148 and feed this minus one volt on line 150 to the toggle servo valve 115 (FIG. 6). Accordingly, the inner jaws 104R and 104L are brought down quickly, but not far enough to contact with the rails.

After the 0.5 second timer has run out, the activation of the toggle cylinder 94 is discontinued. Next, the horizontal cylinder 106C is activated by valve 116 (FIG. 6) at block 214. Continuing to view FIG. 6 in combination with the flow chart of FIG. 11, this step causes the outer jaws 114L and 114R to push in on the rails 58L and 58R. This will bring the loose rail 58L closer to the fixed rail 58R until block 216 indicates that the rails are at narrow gauge. Block 216 simply interrogates the 2920 chip to determine if it has yet output its narrow gauge signal.

If the block 216 indicates that the 2920 has not yet output its narrow gauge signal, the program tests to determine if the gauger switch is up at block 218. If the gauger switch has been placed in an up position, the program passes to block 220 which is a gauger up routine. However, normally the block 218 will determine that the gauger up switch has not been activated and will therefore simply loop back into block 216, the program repeating these steps until the rails are at narrow gauge as indicated by the LVDT sensor and the 2920 signal processing chip 122.

When the 2920 chip signals that the rails are at narrow gauge and the signal is received at block 216, the program of the 8031 deactivates the horizontal cylinder solenoid valve 116 (FIG. 6) and activates the low pressure horizontal cylinder valve 118 at block 222. Whereas the horizontal cylinder 106C was pressurized by 2500 PSI by valve 116 to bring the rails together, the valve 118 simply provides a low pressure for example, 1000 PSI, to resist the outward spreading force caused by the toggle cylinder 94 at block 224. The block 224 causes control lines 146 to operate the selector 148 such that the servo out signal on line 152 is fed to the toggle servo valve 115 (FIG. 6) on line 150. Accordingly, the toggle cylinder 94 is actuated such that inner jaws 104R and 104L push out on the rails until the 2920 sends a spike signal to block 226 of the 8031 program. Referring back momentarily to FIG. 10, this occurs when the block 200 in FIG. 10 indicates that the error is equal to zero. Until the block 226 receives the spike signal from the 2920, it loops to block 228 to test for the gauger switch being an up position. As with block 218, the detection of the gauger switch being up will lead to block 220 which initiates a gauger up routine. However, normally, block 228 will indicate that the gauger switch is not up and will simply loop back into block 226.

If the block 226 does not receive the spike signal from the 2920 chip within the five second interval on the second timer which was initialized in block 204, an interrupt (not shown on the flow chart) will light the error light 143 (FIG. 7 only). Instead of using error light 143, the interrupt could actuate an alarm bell, tape recording or artificially synthesized voice to warn the operator. This will indicate to the operator that the mechanism has not brought the rail to within proper gauge within five seconds indicating the possibility of an obstruction or some other problem. The interrupt will jump back to the same part of the program at block 226 and the program will continue its normal course in the absence of an operator induced change. For example, the operator could change the gauger switch 140 to its up position causing block 228 to lead to block 220.

When the 2920 has sent the spike signal to the 8031 chip at block 226, the program proceeds to block 230 which outputs an OK TO SPIKE signal on electrical line 145 (also shown in FIGS. 7 and 8).

As shown, the OK TO SPIKE signal on electrical line 145 may be fed into an AND gate 232. The other input of the AND gate 232 is a line 232N which is activated when the operator operates a spike control switch (not shown). The output of the end gate 232 controls a line 232T which proceeds to the controls for the spiking guns 20N and 20T (FIG. 2). Accordingly, the operator can not activate the spike hammers for spike guns 20N and 20T unless the OK TO SPIKE signal has been given. Although shown as a single AND gate 232, the system could use a separate AND gate for each of the two spiking guns 20N and 20T.

Block 230 leads to block 234 which tests the gauger switch to determine if it is up. If it is up, control passes to block 220 for the gauger up routine. If it is not up, this block 234 simply loops back to block 230 until the operator has moved the gauger switch to its up position.

The gauger up routine at block 220 simply activates the toggle cylinder 94 and the horizontal cylinder 106C by way of their control valves so as to raise the inner and outer jaws 104R, 104L, 114L, and 114R away from the rails 58L. Specifically, the plus one volt (see especially FIG. 7) is fed to line 150 by the selector 148 to raise the toggle cylinder quickly. If desired, the plus 0.1 volt may then be applied to line 150 to maintain the toggle cylinder 94 biased slightly upwardly. This may minimize any problem with the mechanical imbalance at zero of the toggle cylinder 94. Alternately, the jaws 104R and 104L could be pinned in an upper position.

As shown in FIG. 11, the block 220 returns to the initialized timer block 204 such that the operator may proceed to a different position on the rail and reactivate the gauger by changing the gauger switch 140 (FIG. 7) to the gauger down position.

Unlike the 2920 control program, the program for the 8031 chip as shown in flow chart format FIG. 11 includes numerous different branching or JUMP instructions. Such branching instructions are especially susceptible to causing the program to fail if a noise spike initiates a false branching instruction. The environment of the present machine is quite noisey from an electromagnetic view point. If a noise signal causes an improper jump in the program, this could cause failure of the program.

In order to avoid having a noise signal cause an improper jump in the program, the program of the 8031 chip samples an input thousands of times before it considers that the input is a true value. For example, at block 208 of FIG. 11, the gauger switch may be tested for a consistent indication of a down position for 20,000 samples. If all 20,000 samples indicate that the gauger switch is down, then the gauger down routine 210 is initiated. Since the 20,000 samples may be taken in $\frac{1}{3}$ of a second or less (depending upon the clock frequency of the 8031 chip), the operator of the gauger switch will not perceive any delay. Likewise, if desired, noise immunity may be built into the system at blocks 216, 218, 226, 228, and 234 by taking repetitive samples of an input before considering it as a true input. The detailed operational steps to include this noise immunity feature are listed in appendix 2 of this application which lists step by step a program for the 8031 chip of the present invention.

As discussed above with respect to FIG. 11, the apparatus 10 according to the present invention has been programmed to push in initially on the rails until the narrow gauge signal is received. The mechanism then pushes out on the rails until the error signal is equal to zero at which time the spiking guns may be operated. An alternate program (not shown) may push out on the rails until they are at a predetermined wide gauge and then use a servo signal to push in on the rails until the error is equal to zero at which point the rails may be spiked. In either of these cases the programs operate the gauger in one direction until a BEYOND-GAUGE (either narrow or wide) signal is received, and then operates the gauger in the opposite direction until it is at gauge (e.g., error or SERVOOUT=0). Further, if desired, the rails could be laid wide and pushed in by a servo controlled mechanism to the proper gauge. Alternatively, the rails may be laid at narrow gauge and simply pushed out until the 2920 chip and 8031 chip have indicated that the rails are at proper gauge. Various other programs could be easily used with the present invention because of the great adaptability of the 8031 microprocessor chip 124 and the 2920 signal processing chip 122.

Although specific constructions have been described herein, it is to be understood that these are for illustrative purposes only. Various modifications and adaptations will be apparent to those of ordinary skill in the art. Accordingly, the scope of the present invention should be determined by reference to the claims appended hereto.

APPENDIX I: 2920 PROGRAM

```
;*************METER CALIBRATION************

SUB DAR,DAR,IN3        ; SET DAR TO 0, INPUT 3
IN3                    ; SAMPLE IN3
IN3                    ;  "        "
NOP
CVTS                   ; CONVERT SIGN BIT
NOP
NOP
CVT7                   ; CONVERT BIT 7
NOP
```

```
NOP
CVT6                    ; CONVERT BIT 6
NOP
NOP
CVT5                    ; CONVERT BIT 5
NOP
NOP
LDA METER,KP5,CVT4      ; SET METER TO .250XREF C BIT 4
NOP
NOP
CVT3                    ; CONVERT BIT 3
NOP
NOP
CVT2                    ; CONVERT BIT 2
NOP
NOP
CVT1                    ; CONVERT BIT 1
NOP
NOP
CVT0                    ; CONVERT BIT LSB
LDA MCAL,DAR            ; PUT CONTENTS OF DAR INTO MCAL
ADD METER,MCAL          ; ADD MCAL TO METER
LDA DAR,METER           ; PUT METER INTO THE DAR
NOP
OUT7
OUT7

        ;**********SERVO CALIBRATION***********

SUB DAR,DAR,IN2         ; SET DAR TO 0, SAMPLE 2
IN2                     ;SAMPLE INPUT 2
```

```
IN2                 ;
NOP
CVTS                ; CONVERT THE SIGN BIT
NOP
NOP
CVT7                ; CONVERT BIT 7
NOP
NOP
CVT6                ; CONVERT BIT 6
NOP
NOP
CVT5                ; CONVERT BIT 5
NOP
NOP
CVT4                ; CONVERT BIT 4
NOP
NOP
CVT3                ; CONVERT BIT 3
NOP
NOP
CVT2                ; CONVERT BIT 2
NOP
NOP
CVT1                ; CONVERT BIT 1
NOP
NOP
CVT0                ; CONVERT LSD
LDA SCAL,DAR        ; PUT CONTENTS OF DAR INTO SCAL
NOP
```

```
;**********SAMPLE LVDT SIGNAL**********
SUB DAR,DAR,INO      ; SET DAR TO 0, SAMPLE 0
INO                  ; SAMPLE INPUT 0
INO                  ; "          "
NOP
CVTS                 ; CONVERT THE SIGN BIT
NOP
NOP
CVT7                 ; CONVERT BIT 7
NOP
NOP
CVT6                 ; "          "
NOP
NOP
CVT5                 ; "          "
NOP
NOP
CVT4                 ; "          "
NOP
NOP
CVT3                 ; "          "
NOP
NOP
CVT2                 ; "          "
NOP
NOP
CVT1                 ; "          "
NOP
NOP
CVT0                 ; "          "
LDA LVDT,DAR         ; PUT CONTENTS OF DAR INTO LVDT
NOP
```

```
;**********CONSTRUCT CALIBRATED LVDT SIGNAL*****

ADD LVDT, SCAL        ; ADD SCAL TO LVDT
LDA OLVDT, LVDT       ; PUT LVDT INTO OLVDT
ADD OLVDT, METER      ; SCALE TO PROPER METER CAL
NOP;XLVDT, OLVDT, R02 ;SCALE XLVDT FOR 2920 .8 FACTOR
NOP;OLVDT, XLVDT        ;ADD XLVDT TO OLVDT
LDA DAR, OLVDT        ; LOAD DAR WITH OLVDT
NOP
OUT5
OUT5

;**********SAMPLE TRACK GAUGE SIGNAL******

SUB DAR,DAR,IN1       ; SET DAR TO 0, SAMPLE 1
IN1                   ; SAMPLE INPUT 1
IN1                   ; "          "
NOP
CVTS                  ; CONVERT THE SIGN BIT
NOP
NOP
CVT7                  ; CONVERT BIT 7
NOP
NOP
CVT6                  ; CONVERT BIT 6
NOP
NOP
CVT5                  ; CONVERT BIT 5
NOP
NOP
CVT4                  ; CONVERT BIT 4
```

```
NOP
NOP
CVT3                ;`CONVERT BIT 3
NOP
NOP
CVT2                ; CONVERT BIT 2
NOP
NOP
CVT1                ; CONVERT BIT 1
NOP
NOP
CVT0                ; CONVERT THE LSB
LDA TGAUGE, DAR     ; PUT CONTENTS OF DAR INTO TGAUGE
LDA OGAUGE, TGAUGE  ; PUT TGAUGE INTO OGAUGE
ADD OGAUGE, METER   ; ADD IN METER CAL SIGNAL
NOP;XGAUGE, OGAUGE,R02 ; SCALE XGAUGE FOR 2920 .8 FACTOR
NOP;OGAUGE, XGAUGE  ; ADD XGAUGE TO OGAUGE
LDA DAR, OGAUGE     ; PUT OGAUGE INTO DAR
NOP
OUT6                ; OUTPUT DAR TO OUTPUT 6
OUT6                ; "                    "

        ;**********DEVELOPE THE ERROR SIGNAL*********

LDA ERROR,  TGAUGE  ; LOAD ERROR WITH TRACK GAUGE
SUB ERROR,  LVDT        ; SUBTRACT  LVDT FROM ERROR
NOP;XERROR, ERROR, R02 ; SCALE XERROR FOR 2920 .8 FACTOR
NOP;ERROR, XERROR       ; ADD XERROR TO ERROR
LDA DAR, ERROR          ; PUT CONTENTS OF EGAUGE INTO DAR
NOP
OUT0                    ; OUTPUT DAR TO OUT4
```

```
OUTO                          ;  "                    "

          ;***********SCALE THE SIGNAL TO SERVO VALVE****

LDA SERVOOUT, ERROR           ; SCALE SERVO OUT
NOP;XERVOOUT, SERVOOUT, R02   ; SCALE XERVOOUT .8 FACTOR
NOP;SERVOOUT, XERVOOUT        ; ADD XERVOOUT TO SERVOOUT
LDA DAR, SERVOOUT,L02         ; PUT SERVOOUT INTO DAR
NOP
LDA NARROW,KP1,OUT4           ; OUTPUT DAR INTO OUTO
LDA NARDET,KP7,OUT4           ;  "                    "
          ;***********DEVELOPE NARROW GAUGE SIGNAL********

LDA NGAUGE, TGAUGE    ; MAKE NGAUGE EQUAL TO TGAUGE
SUB NGAUGE, NARROW    ; SUBTRACT .12500 FROM NGAUGE
SUB LVDT,  NGAUGE     ; SUBTRACT NGAUGE FROM  LVDT
LDA DAR, LVDT         ; LOAD DAR WITH LVDT
NOP;NARDET, KP0,CND0  ; NARDET TO .0 IF CND0=HIGH
NOP;NARDET, KP0,CND1  ;  "              "  CND1=HIGH
LDA NARDET, KP0,CND2  ;  "              "  CND2=HIGH
LDA NARDET, KP0,CND3  ;  "              "  CND3=HIGH
LDA NARDET, KP0,CND4  ;  "              "  CND4=HIGH
LDA NARDET, KP0,CND5  ;  "              "  CND5=HIGH
LDA NARDET, KP0,CND6  ;  "              "  CND6=HIGH
LDA NARDET, KP0,CND7  ;  "              "  CND7=HIGH
LDA NARDET, KP7,CNDS  ;  "              "  CNDS=HIGH
LDA DAR, NARDET       ; PUT NARDET INTO DAR
NOP
LDA SPIKE, KP7, OUT2  ; OUTPUT DAR TO OUT2
OUT2
```

```
;**********DEVELOPE "OK TO SPIKE SIGNAL"

LDA DAR, ERROR          ; LOAD DAR WITH ERROR SIGNAL
LDA SPIKE, KP0, CND7    ; SPIKE TO 0 IF CND7 HIGH
LDA SPIKE, KP0, CND6    ; "                 6    "
LDA SPIKE, KP0, CND5    ; "                 5    "
LDA SPIKE, KP0, CND4    ; "                 4    "
LDA SPIKE, KP0, CND3    ; "                 3    "
LDA SPIKE, KP0, CND2    ; "                 2    "
NOP;SPIKE, KP0, CND1    ; "                 1    "
NOP;SPIKE, KP0, CND0    ; "                 0    "
LDA DAR, SPIKE          ; LOAD DAR WITH SPIKE SIGNAL
NOP
OUT3
EOP
NOP
NOP
NOP
```

APPENDIX II: 8031 PROGRAM

---

```
;
;****************FAIRMONT AUTO GAUGER*****************
;
;                    INPUT PIN DECLARATIONS
;              ( ALL INPUTS ARE NEGATIVE LOGIC
;            INPUTS ARE LOW WHEN SWITCH IS CLOSED)
;
GA_UP   BIT  P1.7  ; GAUGER UP SWITCH ACTIVATED
GA_DWN  BIT  P1.6  ; GAUGER DOWN SWITCH ACTIVATED
NAR_GA  BIT  P3.0  ; NARROW GAUGE
OF      BIT  P3.1  ; OF FROM 2920
```

```
RST     BIT  P3.2  ; RST NOT 2920 INPUT
OK_SPK BIT P1.5    ; OK TO SPIKE
;
;                    OUTPUT PIN DECLARATIONS
;                ( ALL OUTPUTS ARE NEGATIVE LOGIC
;                OUTPUTS ARE LOW WHEN DEVICE IS ON)
;
T_OUT     BIT  P1.4  ; TIMER OUTPUT
FST_DWN   BIT  P1.3  ; TOGGLE CYLINDER FAST DOWN
SLW_UP    BIT  P1.2  ; TOGGLE CYLINDER SLOW UP
FST_UP    BIT  P1.1  ; TOGGLE CYLINDER FAST UP
ENG_SVO   BIT  P1.0  ; ENGAGE SERVO VALVE
RUN_PRO   BIT  P3.3  ; RUN 2920 PROGRAM
ERROR     BIT  P3.4  ; ERROR SIGNAL OUT
REL_SOL   BIT  P3.5  ; RELIEF SOL OUT
HOR_RET   BIT  P3.6  ; HORIZONTAL CYLINDER RETRACT
HOR_EXT   BIT  P3.7  ; HORIZONTAL CYLINDER EXTEND
;
SUB_DIV   DATA  20H  ; INTERRUPT REQUEST FLAG TIMER 0
DUB_DIV   DATA  21H  ; INTERRUPT REQUEST FLAG TIMER 1
NCOUNT    DATA  22H  ; NGAUGE UP TEST
SCOUNT    DATA  23H  ; SPIKE  UP TEST
GCOUNT    DATA  24H  ; GAUGE  UP TEST
NOUNT     DATA  25H  ; NGAUGE UP TEST HIGH BYTE
SOUNT     DATA  26H  ; SPIKE  UP TEST HIGH BYTE
GOUNT     DATA  27H  ; NGAUGE UP TEST HIGH BYTE
;
;***************MAIN BODY OF PROGRAM***************
;
ORG      0000H      ; RESET VECTOR
;
;
```

```
;*****************INITIALTION OF PORTS***********
;
WAIT:  MOV  P3, #0F7H          ; SET PORT THREE UP
       MOV  P1, #0FBH          ; SET PORT ONE UP
       LJMP   0030H            ; JUMP TO MAIN PROGRAM BODY
;
;
;*********TIMER ONE        INTERRUPT REQUEST**********
ORG     001BH              ; THIS IS THE RETURN ADDRESS OF TIMER INT.
MOV     TH1,#-16           ; SET THE HIGH ORDER BIT OF TIMET 1
PUSH    PSW                ; EXECUTE CODE TO SAVE ANY REGISTERS USED
DJNZ    DUB_DIV,  002BH    ; DEC AND JUMP TO 0016H IF NOT ZERO
SETB    C                  ; SET B
MOV     FST_DWN, C         ; DE-ENERGISE FAST DOWN
MOV     DUB_DIV, #15       ; SET SCALER VECTOR TO .7 SECOND
CLR     TR1                ; SHUT OFF TIMER ONE
NOP
POP     PSW                ; RESTORE REGISTERS
RETI                       ; RETURN FROM INTERRUPT
;
;
;*****************TIMER ZERO INTERRUPT REQUEST***********
;
ORG     000BH              ; START PROGRAM COUNTER AT 0030H
MOV     TH0, #-16          ; SET THE HIGH ORDER BIT
PUSH    PSW                ; EXECUTE CODE TO SAVE ANY REG. USED
DJNZ    SUB_DIV, 0018H     ; DEC AND JUMP TO 003DH IF NOT ZERO
CPL     ERROR              ; COMPLIMENT THE ERROR BIT
MOV     SUB_DIV, #122      ; RESET THE SCALER VECTOR
POP     PSW                ; EXECUTE CODE TO RESORE REGISTERS
RETI                       ; RETURN FROM THE INTERRUPT
```

```
;****************INITIALIZATION OF TIMERS*****************
;
ORG     0030H              ; START PROGRAM COUNTER AT 50
MOV     NCOUNT,#250        ; PUT 500 IN  COUNT
MOV     SCOUNT,#250        ;  "            "
MOV     GCOUNT,#250        ;  "            "
MOV     NOUNT ,#10         ; PUT 10 IN COUNT
MOV     SOUNT ,#10         ;  "            "
MOV     GOUNT ,#10         ;  "            "
MOV     TL0,#0             ; LOW ADDRESS BYTE TO 0 DECIMAL
MOV     TH0,#-16           ; HIGH ADDRESS BYTE TO -16 DECIMAL
MOV     TL1,#0             ; LOW ADDRESS BYTE TO 0 DECIMAL
MOV     TH1,#-16           ; HIGH ADDRESS BYTE TO -16 DECIMAL
MOV      TMOD,    #00010001B ; SET TIMER 0 & 1 TO A 16 BIT TIMER
MOV      DUB_DIV, #15      ; THIS GIVES TIMER 1 A 1 SECOND DURATION
MOV      SUB_DIV, #122     ; THIS GIVES TIMET 0 A 5 SECOND DURATION
SETB     ET0               ; ENABLES TIMER 0 INTERRUPT
SETB     ET1               ; ENABLES TIMER 1 INTERRUPT
SETB     EA                ; ENABLES CONTROL OF TIMER INTERRUPTS
SETB     PT0               ; SET TIMER ZERO AS PRIORITY ONE
;
;
;*******************TEST OF GAUGER SWITCHES********
TEST:   JNB 97H, RETRACT   ; JUMP TO RETRACT IF BUTTON IS PUSHED
        JNB 96H, GAUGE     ; JUMP TO GAUGE IF BUTTON IS PUSHED
        LJMP TEST          ; JUMP TO TEST
;
;
;*****************CYLINDER RETRACT SEQUENCE******
;
RETRACT:  SETB C           ; SET C BIT HIGH
```

```
        MOV   HOR_EXT, C  ; SET HOR_EXT HIGH
        MOV   REL_SOL, C  ; "   REL_SOL   "
        MOV   SLW_UP,  C  ; "   SLW_UP    "
        MOV   FST_DWN, C  ; "   FST_DWN   "
        MOV   ENG_SVO, C  ; "   ENG_SVO   "
        MOV   ERROR,   C  ; "   ERROR     "
        CLR C             ; CLEAR BIT C
        CLR TR0           ; SHUT OFF TIMER 0
        CLR TR1           ; SHUT OFF TIMER 1
        MOV DUB_DIV, #15  ; RESET SCALER
        MOV SUB_DIV, #122 ; RESET SCALER
        MOV   HOR_RET, C  ; DE-ENERGISE HOR. CYL. EXTEND
        MOV   FST_UP,  C  ;  "          TOGGLE  CYL.
        LJMP TEST         ; JUMP TO TEST
;
;
;*******************GAUGE TRACK***********************
;
GAUGE:  CLR  C            ; CLEAR BIT C
        SETB TR0          ; ENABLES TIMER ZERO
        SETB TR1          ; ENABLES TIMER ONE
        MOV FST_DWN, C    ; ENGAGE FAST DOWN SERVO
;
;
TGAUGE: SETB C            ; SET BIT C
        MOV  HOR_RET, C   ; DE-ENERGISE HOR RET. SOL.
        MOV  FST_UP,  C   ; "        "  FAST UP SERVO
        MOV  SLW_UP,  C   ; "        "  SLOW UP SERVO
        CLR C             ; CLEAR BIT C
        MOV  HOR_EXT, C   ; ENERGISE HOR. EXTEND SOL.
        JB   0B0H, NGAUGE ; JUMP TO NGAUGE IF AT NARROW GA.
```

```
        JNB  97H, GUPNOW   ; JUMP TO WAIT IF BUTTON PUSHED
        SJMP TGAUGE        ; LOOP BACK TO TGAUGE
;
;
;***************GAUGE UP BUTTON TEST*****************
;
GUPNOW: DJNZ  GCOUNT, TGAUGE  ; DECREMENT AND JUMP IF NOT 0
        DJNZ  GOUNT,  TGAUGE  ; "                        "
        LJMP  WAIT            ; JUMP TO WAIT
;*******************NARROW GAUGE*********************
;
NGAUGE: SETB C                ; SET BIT C
        CLR  TR0              ; CLEAR TIMER 0
        CLR  TR1              ; CLEAR TIMER 1
        MOV  DUB_DIV, #15     ; CLEAR SCALER
        MOV  SUB_DIV, #122    ; CLEAR SCALER
        MOV  ERROR, C         ; CLEAR ERROR LIGHT
        MOV  HOR_EXT, C       ; DE_ENERGISE HOR. EXTEND
;
;
;******************NARROW GAUGE LOOP******************
;
MGAUGE: SETB TR0              ; ACTIVATE TIMER 0
        SETB C                ; SET BIT C
        MOV  FST_DWN, C       ; DE-ENERGISE FAST DOWN
        MOV  HOR_EXT, C       ; DE-ENERGISE HOR EXTEND
        CLR C                 ; CLEAR BIT C
        MOV  REL_SOL, C       ; TURN ON REL. SOL.
        MOV  ENG_SVO, C       ; TURN ON SERVO
        JNB  97H, NUPNOW      ; JUMP TO WAIT IF UP IS PUSHED
        JB   95H, SPIKE       ; JUMP TO SPIKE IF GAUGE IS REACHED
```

```
        SJMP MGAUGE          ; LOOP BACK TO MGAUGE
;
;**********************UP BUTTON TEST NARROW GAUGE*************
;
NUPNOW:   DJNZ  NCOUNT, MGAUGE  ;DECREMENT AND JUMP IF NOT 0
          DJNZ  NOUNT,  MGAUGE  ;"                          "
          LJMP  WAIT            ; JUMP TO WAIT
;**********************OK TO SPIKE*****************
;
SPIKE:    JNB  97H,  SUPNOW ; JUMP TO WAIT IF UP IS PUSHED
          CLR   TR0         ; SHUT TIMER 0 OFF
          CLR   TR1         ; CLEAR TIMER 1
          MOV DUB_DIV, #15  ; CLEAR SCALER
          MOV SUB_DIV, #122 ; CLEAR SCALER
          SETB C            ; SET BIT C
          MOV ERROR, C      ; CLEAR ERROR LIGHT
          MOV HOR_EXT, C    ; DE-ENERGISE HOR. EXTEND
          MOV HOR_RET, C    ; DE-ENERGISE HOR. RETRACT
          MOV FST_UP, C     ; DE-ENERGISE FAST UP
          MOV SLW_UP, C     ; DE-ENERGISE SLOW UP
          MOV FST_DWN, C    ; DE-ENERGISE FAST DOWN
          CLR C             ; CLEAR BIT C
          MOV REL_SOL, C    ; ENGAGE REL. SOL.
          MOV ENG_SVO, C    ; ENGAGE SERVO VALVE
          SJMP SPIKE        ; LOOP BACK TO SPIKE
;
;
;****************UP BUTTON TEST OK TO SPIKE************
;
SUPNOW:  DJNZ  SCOUNT, SPIKE  ; DECREMENT AND JUMP IF NOT 0
         DJNZ  SOUNT,  SPIKE  ; "                          "
         LJMP  WAIT           ; JUMP TO WAIT
;
END
```

What is claimed is:

1. A railroad measuring, gauging and spiking apparatus operable to bring a distance between rails to a desired gauge comprising:

a frame;

a first rail feeler mounted to said frame for contacting one of a pair of rails;

second and third rail feelers mounted to said frame for contacting the other of the pair of rails at two different locations, each of said rail feelers being a rail gauge feeler, said first rail feeler being movable with respect to at least one of said second and third rail feelers;

a sensor for detecting a relative position of said first rail feeler with respect to at least one of said second and third rail feelers, said sensor outputting a sensor output representative of the gauge of the rails;

a gauging mechanism operable in a first direction and in a second direction to change the distance between the pair of rails, said gauging mechanism including inboard pushing means for increasing a separation between the rails and outboard pushing means for decreasing the separation between the rails;

a feedback control circuit operable to receive said sensor output and operable to compare an actual gauge of the rails with the desired gauge of the rails as set on the gauge setter and operable to control said gauging mechanism to automatically bring the rails into the desired gauge; and a spiker for spiking at least one rail into position after the gauging mechanism has brought the rails to the desired gauge.

2. The apparatus of claim 1 wherein said sensor output is representative of the gauge of the rails at a point intermediate said two different locations and said spiker is located intermediate said two different locations.

3. The apparatus of claim 2 wherein said frame is a spiker carriage frame mounted on a vehicle chassis and said spiker is mounted on said spiker carriage frame and said spiker frame is movable with respect to said vehicle chassis at least perpendicularly to the rails.

4. The apparatus of claim 3 wherein each of said first, second, and third rail feelers is a wheel, said first rail feeler is mounted for sliding relative to said spiker carriage frame and is disposed intermediate said two different locations, and said spiker includes two spiking guns, each spiking gun being mounted for independent positioning on said spiker carriage frame.

5. The apparatus of claim 3 wherein said spiker includes two spiking guns, said second and third rail feelers are fixed to said spiker carriage frame such that said spiker carriage frame follows said other of the two rails to maintain said spiking guns in line with holes into which said spiking guns insert spikes.

6. The apparatus of claim 5 wherein said feedback control circuit includes:

a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge; and a microprocessor operable to cause said gauging mechanism to operate in said first direction until said beyond-gauge signal is received from said signal processing circuit, at which point, said microprocessor is operable to cause said gauging mechanism to operate in said second direction and stop upon receiving said at-gauge signal from said signal processing circuit.

7. The apparatus of claim 6 further including:

a sensing cylinder having a piston therein, one of said sensing cylinder and said piston fixed relative to said frame and the other of said sensing cylinder and said piston slidable relative to said frame and supporting said first rail feeler, said sensing cylinder and said piston operable to bias said first rail feeler away from said second and third rail feelers by pressurized fluid within said sensing cylinder, and said sensor is within said sensing cylinder.

8. The apparatus of claim 1 wherein said sensor output is representative of the gauge of the rails at a gauge point and said gauge point is closer to said spiker than it is to said gauging mechanism.

9. The apparatus of claim 1 wherein said outboard pushing means includes two outer jaws operable to push against rail webs by activation of a horizontal cylinder and said inboard pushing means includes two inner jaws operable to push against rail webs by activation of an inboard cylinder.

10. The apparatus of claim 2 wherein said second and third rail feelers are fixed relative to each other.

11. A railroad measuring, gauging, said spiking apparatus for bringing a distance between rails to a desired gauge comprising:

a frame;

a sensor mounted to said frame and having a sensor output representative of the distance between a pair of rails;

a gauging mechanism operable in a first direction and in a second direction to change the distance between the pair of rails, said gauging mechanism including inboard pushing means for increasing a separation between the rails and outboard pushing means for decreasing the separation between the rails;

a gauge setter for setting the desired gauge of the rails;

a spiker for spiking at least one rail into position after the gauging mechanism has brought the rails to proper gauge;

a feedback control circuit operable to receive said sensor output and operable to compare an actual gauge of the rails with the desired gauge of the rails as set on said gauge setter and operable to control said gauging mechanism to automatically bring the rails into the desired gauge, said feedback control circuit including;

a signal processing circuit outputting a beyond-gauge signal indicating that the gauging mechanism has caused the rails to be a minimum distance past the desired gauge and outputting an at-gauge signal for indicating that the gauging nmechanism gauge; and has caused the rails to be at the desired gauge; and a gauger control circuit operable to cause said gauging mechanism to operate in said first direction until said beyond-gauge signal is received from said signal processing circuit, a which point, said gauger control circuit is operable to cause said gauging mechanism to operate in said second direction and stop upon receiving said at-gauge signal from said signal processing circuit.

12. The apparatus of claim 11 wherein said gauger control circuit is a microprocessor.

13. The apparatus of claim 12 wherein said sensor output is representative of the gauge of the rails at a gauge point and said gauge point is closer to said spiker than it is to said gauging mechanism.

14. The apparatus of claim 12 further including:

a first rail feeler mounted to said frame for contacting one of a pair of rails;

second and third rail feelers mounted to said frame for contacting the other of the pair of rails at two different locations, said first rail feeler being movable with respect to at least one of said second and third rail feelers, each of said rail feelers being a rail gauge feeler; and wherein said sensor senses the gauge of the rails at a point intermediate said two different locations by detecting the position of said first rail feeler.

15. The apparatus of claim 14 wherein said frame is a spiker carriage frame movably mounted to a vehicle chassis, said spiker is mounted to said spiker carriage frame, said second and third rail feelers are fixed to said spiker carriage frame, and said first rail feeler is slidably mounted to said spiker carriage frame.

16. The apparatus of claim 15 further including:

a sensing cylinder having a piston therein, one of said sensing cylinder and said piston fixed relative to said frame and the other of said sensing cylinder and said piston slidable relative to said frame and supporting said first rail feeler, said sensing cylinder and said piston operable to bias said first rail feeler away from said second and third rail feelers by pressurized fluid within said sensing cylinder, and said sensor is within said sensing cylinder.

17. The apparatus of claim 12 further including a meter connected to said signal processing circuit, and wherein said signal processing circuit is connected to receive a meter cal in signal operable to calibrate said meter and a servo cal in signal operable to calibrate a servoloop including said sensor and said gauging mechanism, and said signal processing circuit outputs an actual gauge signal, a desired gauge signal, and an error signal, said error signal being fed to a servovalve which controls one of said outboard pushing means and said inboard pushing means.

18. The apparatus of claim 17 wherein said signal processing circuit is programmable and includes an input multiplexer and an output multiplexer.

19. The apparatus of claim 18 wherein said microprocessor receives an input from a gauger switch, said gauger switch being disposable in an up position and in a down position, wherein said microprocessor is operable to raise and lower said gauging mechanism depending on the position of said gauger switch.

20. The apparatus of claim 12 wherein said microprocessor outputs an OK TO SPIKE signal when the rails are at gauge and said spiker will not spike until the OK TO SPIKE signal has been output.

21. A railroad measuring, gauging and spiking apparatus operable to bring a distance between rails to a desired gauge comprising;

a frame;

a sensor mounted on said frame having a sensor output representative of the distance between a pair of rails at a gauge point;

a gauging mechanism operable in a first direction and in a second direction to change the distance between the pair of rails, said gauging mechanism including inboard pushing means for increasing a separation between the rails and outboard pushing means for decreasing the separation between the rails;

a gauge setter for setting the desired gauge of the rails;

a feedback control circuit operable to receive said sensor output and operable to compare an actual gauge of the rails with the desired gauge of the rails as set on the gauge setter and operable to control said gauging mechanism to automatically bring the rails into the desired gauge; and a spiker for spiking at least one rail into position after the gauging mechanism has brought the rails to the desired gauge; and wherein said gauge point is closed to said spiker than it is to said gauging mechanism.

22. The apparatus of claim 21 wherein said apparatus has a length and said sensor is located at a different place in the length of said apparatus than said gauging mechanism.

23. The apparatus of claim 21 further including:

a sensing cylinder having a piston therein, one of said sensing cylinder and said piston fixed relative to said frame and the other of said sensing cylinder and said piston slidable relative to said frame and supporting a first rail feeler, said sensing cylinder and said piston operable to bias said first rail feeler against a rail by pressurized fluid within said sensing cylinder, and said sensor is within said sensing cylinder.

24. The apparatus of claim 21 wherein said feedback control circuit includes:

a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge, and a microprocessor operable to cause said gauging mechanism to operate in said first direction until said beyond-gauge signal is received from said signal processing circuit, at which point, said microprocessor is operable to cause said gauging mechanism to operate in said second direction and stop upon receiving said at-gauge signal from said signal processing circuit.

25. The apparatus of claim 24 wherein said signal processing circuit is programmable and includes an input multiplexer and an output demultiplexer.

26. The apparatus of claim 25 wherein a meter connected to said signal processing circuit, and wherein said signal processing circuit is connected to receive a meter cal in signal operable to calibrate said meter and a servo cal in signal operable to calibrate a servoloop including said sensor and said gauging mechanism, and said signal processing circuit outputs an actual gauge signal, a desired gauge signal, and an error signal, said error signal being fed to a servovalve which controls one of said outboard pushing means and said inboard pushing means.

27. The apparatus of claim 26 wherein said microprocessor outputs an OK TO SPIKE signal when the rails are at gauge and said spiker will not spike until the OK TO SPIKE signal has been output.

28. The apparatus of claim 27 wherein said microprocessor receives an input from a gauger switch, said gauger switch being disposable in an up position, and in a down position, said microprocessor is operable to raise and lower said gauging mechanism depending on the position of said gauger switch.

29. The apparatus of claim 24 wherein said frame is a spiker carriage frame movably mounted to a vehicle chassis, and said spiker is mounted on said spiker carriage frame.

30. A railroad measuring, gauging, and spiking apparatus operable to bring a distance between rails to a desired gauge comprising:

a spiker carriage frame movably mounted to a vehicle frame;

a sensor mounted to said spiker carriage frame and having a sensor output representative of the distance between a pair of rails at a gauge point;

a gauging mechanism operable in a first direction and in a second direction to change the distance between the pair of rails, said gauging mechanism including inboard pushing means for increasing a separation between the rails and outboard pushing means for decreasing the separation between the rails;

a gauge setter for setting the desired gauge of the rails;

a feedback control circuit operable to receive said sensor output and operable to compare an actual gauge of the rails with the desired gauge of the rails as set on the gauge setter and operable to control said gauging mechanism to automatically bring the rails into the desired gauge; and a spiker for spiking at least one rail into position after the gauging mechanism has brought the rails to the desired gauge; and wherein said spiker is mounted on said spiker carriage frame.

31. The apparatus of claim 30 wherein said feedback control circuit includes:

a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge; and a microprocessor operable to cause said gauging mechanism to operate in said first direction until said beyond-gauge signal is received from said signal processing circuit, at which point, said microprocessor is operable to cause said gauging mechanism to operate in said second direction and stop upon receiving said at-gauge signal from said signal processing circuit.

32. The apparatus of claim 31 wherein said signal processing circuit is programmable and includes an input multiplexer and an output demultiplexer.

33. The apparatus of claim 32 wherein said microprocessor outputs an OK TO SPIKE signal when the rails are at gauge and said spiker will not spike until the OK TO SPIKE signal has been output.

34. The apparatus of claim 31 further including:

a first rail feeler mounted to said spiker carriage frame for contacting one of the pair of rails;

second and third rail feelers mounted to said spiker carriage frame for contacting the other of the pair of rails at two different locations, said first rail feeler being movable with respect to at least one of said second and third rail feelers; and wherein said sensor senses the gauge of the rails at a point intermediate said two different locations by detecting the position of said first rail feeler.

35. The apparatus of claim 31 further including:

a meter connected to said signal processing circuit to display rail gauge;

a meter calibrator inputting a meter cal in signal to said signal processing circuit; and a servo calibrator inputting a servo cal in signal to said signal processing circuit;

and wherein said meter calibrator is adjustable to change said meter cal in signal such that said meter is properly calibrated to display one or more outputs from said signal processing circuit, and wherein said servo calibrator is adjustable to change said servo cal in signal such that the servoloop including said sensor, said feedback control circuit, and said gauging mechanism is properly calibrated.

36. The apparatus of claim 31 wherein said gauge point is closer to said spiker than it is to said gauging mechanism.

37. A railroad measuring, gauging and spiking apparatus operable to bring a distance between rails to a desired gauge comprising:

a frame;

a sensor mounted on said frame having a sensor output representative of the distance between a pair of rails at a gauge point;

a gauging mechanism operable in a first direction and in a second direction to change the distance between the pair of rails, said gauging mechanism including inboard pushing means for increasing a separation between the rails and outboard pushing means for decreasing the separation between the rails;

a gauge setter for setting the desired gauge of the rails;

a feedback control circuit operable to receive said sensor output and operable to compare an actual gauge of the rails with the desired gauge of the rails as set on the gauge setter and operable to control said gauging mechanism to automatically bring the rails into the desired gauge; and a spiker for spiking at least one rail into position after the gauging mechanism has brought the rails to the desired gauge; and wherein said feedback conrol circuit outputs to OK TO SPIKE signal when the rails are at gauge and said spiker will not spike until the OK TO SPIKE signal has been output.

38. The apparatus of claim 37 wherein said feedback control circuit includes:

a signal processing circuit outputting a beyond-gauge signal indicating that the gauging mechanism has caused the rails to be a minimum distance past the desired gauge and outputting an at-gauge signal for indicating that the gauging mechanism has caused the rails to be at the desired gauge, and a microprocessor operable to cause said gauging mechanism to operate in said first direction until said beyond-gauge signal is received from said signal processing circuit, at which point, said microprocessor is operable to cause said gauging mechanism to operate in said second direction and stop upon receiving said at-gauge signal from said signal processing circuit.

39. The apparatus of claim 38 wherein said frame is a spiker carriage frame movably mounted to a vehicle chassis, and said spiker is mounted on said spiker carriage frame.

40. The apparatus of claim 37 wherein said gauging point is closer to said spiker than it is to said gauging mechanism.

41. The apparatus of claim 37 further including:

a first rail feeler mounted to said frame for contacting one of a pair of rails;

second and third rail feelers mounted to said frame for contacting the other of the pair of rails at two different locations, said first rail feeler being movable with respect to at least one of said second and third rail feelers; and wherein said sensor senses the gauge of the rails at a point intermediate said two different locations by detecting the position of said first rail feeler.

* * * * *